US005268158A

United States Patent [19]

Paul, Jr.

[11] Patent Number: 5,268,158

[45] Date of Patent: Dec. 7, 1993

[54] HIGH MODULUS PAN-BASED CARBON FIBER

[75] Inventor: James T. Paul, Jr., Wilmington, Del.

[73] Assignee: Hercules Incorporated, Wilmington, Del.

[21] Appl. No.: 391,073

[22] Filed: Aug. 9, 1989

Related U.S. Application Data

[63] Continuation of Ser. No. 24,508, Mar. 11, 1987, abandoned.

[51] Int. Cl.[5] ..... D01F 9/12

[52] U.S. Cl. ..... 423/447.1; 423/547.2; 423/447.9; 423/447.6; 423/460; 264/292

[58] Field of Search ..... 423/447.1, 447.2, 447.4, 423/447.6, 460; 264/29.2

[56] References Cited

U.S. PATENT DOCUMENTS

| | | | |
|---|---|---|---|
| 3,723,150 | 3/1973 | Drain et al. | 423/447.1 |
| 3,745,104 | 7/1973 | Hai | 423/447.1 |
| 3,775,520 | 11/1973 | Ram et al. | 423/447.1 |
| 3,894,884 | 7/1975 | Drain et al. | 423/447.2 |
| 4,009,305 | 2/1977 | Fujimaki et al. | 423/460 |
| 4,100,004 | 7/1978 | Moss et al. | 264/29.2 |
| 4,131,644 | 12/1978 | Nagasaka et al. | 264/29.2 |
| 4,535,027 | 8/1985 | Kobashi et al. | 423/447.1 |
| 4,600,572 | 7/1986 | Hiramatsu et al. | 423/447.1 |
| 4,609,540 | 9/1986 | Izumi et al. | 423/447.4 |
| 4,610,860 | 9/1986 | Mullen | 423/447.4 |
| 5,004,590 | 4/1991 | Schimpf | 423/447.2 |

FOREIGN PATENT DOCUMENTS

| | | | |
|---|---|---|---|
| 1181555 | 1/1985 | Canada | 264/29.2 |
| 0165465 | 5/1985 | European Pat. Off. | 264/29.2 |
| 61-124674 | 6/1986 | Japan | 423/447.1 |
| 61-152826 | 7/1986 | Japan | 423/447.4 |
| 8501752 | 4/1985 | PCT Int'l Appl. | 423/447.1 |

OTHER PUBLICATIONS

ACM, ACM Monthly, Issue No. 167, Sep. 1985, Composite Market Reports, p. 8.

*Primary Examiner*—Robert Kunemund
*Attorney, Agent, or Firm*—David Edwards

[57] ABSTRACT

Novel carbon fiber in the form of a plurality of tows or bundles comprising a multitude of continuous filaments is disclosed. The novelty of the carbon fiber resides in its unique combination of mechanical properties that make it admirably suited for use in composites comprising an organic matrix. Such composites are particularly useful in aerospace applications that have designs in which weight and performance are critical.

14 Claims, 16 Drawing Sheets

HIGH MODULUS PAN-BASED CARBON FIBER

This application is a continuation of Ser. No. 07/024,508 filed on Mar. 11, 1987 now abandoned.

This invention relates to carbon fiber in the form of filamentary tows comprising a multitude of continuous filaments and, more particularly, carbon fiber made from polyacrylonitrile (PAN) precursor and suitable for use in making composites. This invention, even still more particularly, relates to such a carbon fiber having a novel combination of advantageous physical properties.

Carbon fiber is a well known material that enables manufacture of very strong, lightweight composites comprising the fiber and a resinous or carbonized matrix. Carbon fiber, also known as graphite fiber, as used herein refers to filamentary materials having at least about 93% by weight carbon and in the form of filamentary tows having a multitude of individual filaments. The particular carbon fiber to which this invention relates has greater than 96% by weight carbon.

The mechanical properties of carbon fiber (e.g. modulus, tensile strength) available to the art have been improved over the past several years. Also, the types of carbon fiber available, once limited to high modulus but low tensile strength carbon fiber or higher tensile strength but lower modulus carbon fiber, are now diverse. For example, a series of intermediate modulus carbon fibers (i.e. modulus between 40 and 50 million psi that is between that of high and lower modulus carbon fiber) and tensile strengths equal to that (i.e. above 600 thousand psi) of lower modulus carbon fiber are now available. These intermediate modulus carbon fibers have been made through better appreciation of the changes in morphology in the materials undergoing conversion to the carbon fiber. See, for example, U.S. Ser. No. 520,785 filed Aug. 5, 1982 in the name of Schimpf, Hansen, Paul and Russell.

High modulus carbon fiber available to the art, however, still has low tensile strengths. For example, the high modulus pitch-based carbon fiber, Thornel TM P-755, has a reported modulus of 75 million psi but a reported tensile strength of only 300 thousand psi. on the other hand, high modulus pan-based carbon fiber "GY-70" has a reported modulus of 75 million psi but a reported tensile strength of only 270 thousand psi. Moreover, the compressive strengths of this type of material has been quite low, a serious detriment for aerospace applications. See also U.S. Pat. No. 4,301,136 to Yamamoto, et al. wherein carbon fiber having a modulus of about 56 million psi and a tensile strength of about 370 thousand psi is disclosed.

The disadvantage of the intermediate modulus materials was dramatically illustrated in the take-off of the "Voyager" aircraft where the wings, heavily laden with fuel, sagged so much during takeoff as to scrap along the run-way. Clearly, a higher modulus composite wing would not suffer such a risk of catastropic failure. Moreover, the wings, when made with a carbon fiber composite that has high tensile strength and high compressive strength, should be better able to sustain the tension and compression loads such as seen by the "Voyager" in flight.

Now, in accordance with this invention, it has been discovered that the modulus in carbon fiber can be increased over 30% higher than in intermediate modulus carbon fiber while still maintaining exceptional tensile and adequate compressive strengths and suitable surface activity for use in composites. Thus, the carbon fiber of this invention has a modulus and tensile strength, as defined in a Tow Test (hereinafter described), respectively between about 59 and 75 million psi and 500 and 750 thousand psi and a short beam shear strength, as defined in a Laminate Test (hereinafter described), between 6 and 15 thousand psi.

The carbon fiber comprises filaments each having a diameter between 3 and 6 microns and a coefficient of variation ($C_v$) ranging typically up to 5%. The strain (calculated) of the carbon fiber ranges between 0.8% and 1.3% wherein strain is calculated by dividing the tensile strength by modulus. The carbon fiber has a composite compressive strength, according to ASTMD 695, that is between 120 and 200 thousand psi at 62% fiber volume.

BRIEF DESCRIPTION OF THE DRAWINGS

The procedures of the Tow and Laminate Tests are described in the Appendices I an II appearing at the end of this specification.

FIG. 19 depicts a tar remover temperature profile.

FIG. 21 depicts a schematic of a running heat tension checker, FIG. 22 an apparatus for measuring dry heat elongation and FIG. 23 a model chart of a load-time (elongation) curve.

DETAILED DESCRIPTION OF THE INVENTION

Figure 1:
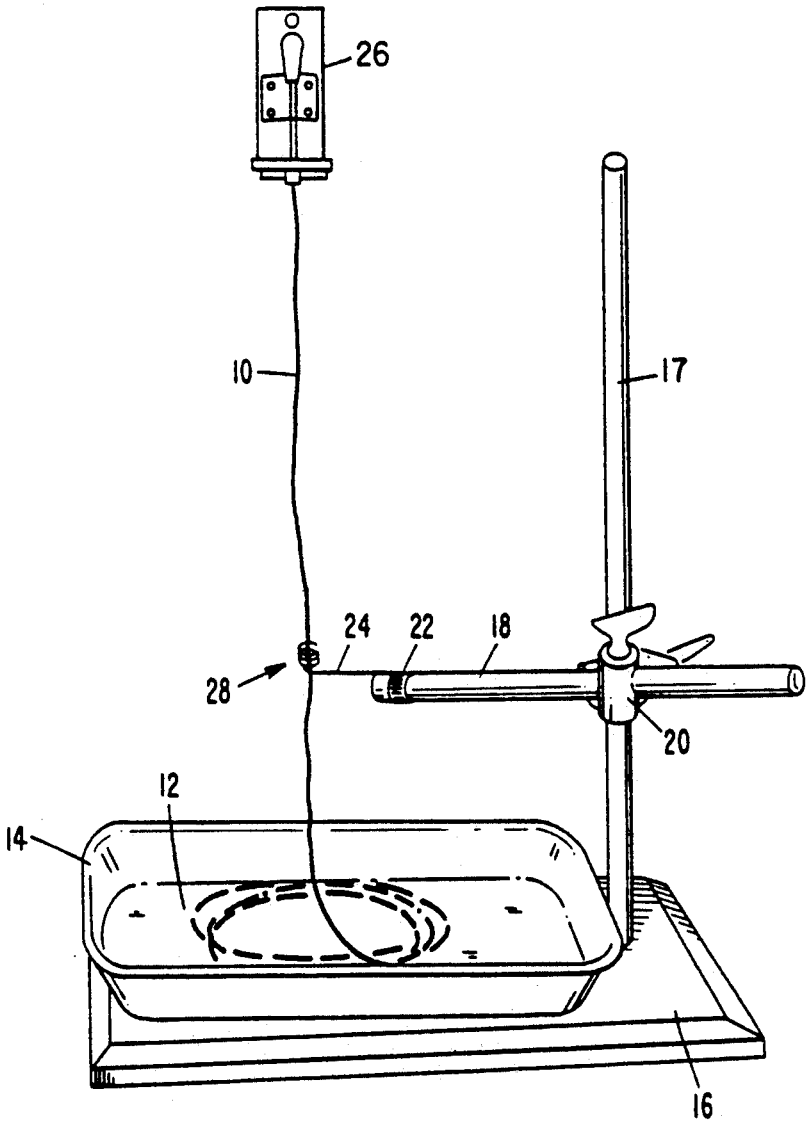
FIGS 1, 2, 3*a*, 3*b*, 4*a*–4*d*, 5*a*–5*d*, 6*a*–6*e*, 7*a*–7*c*, 8*a*–8*c*, 9*a*, 9*b*, 10, 11, 12, 13, 14, 15*a*, 15*b*, 16, 16*a*, 17, 18*a*, and 18*b* depict apparatus and fixtures used in these procedures. The Tow Test values hereof are properties of carbon fiber that is not surface treated. The Laminate Test values hereof are properties measured on the carbon fiber which has been surface treated, typically by electrolytic surface treatment.

The process of making the carbon fiber hereof comprises stretching a previously stretched and oxidized polyacrylonitrite precursor to a certain extent as it passes through low temperature and first high temperature furnaces followed by stretching the resulting carbonized precursor again as it passes through a second, still higher temperature furnace. The partially carbonized precursor undergoing carbonization in the first high temperature furnace is allowed to shrink or at least is not increased in length as it passes through this first high temperature furnace but is stretched, or at least not allowed to shrink in the second high temperature furnace.

In a first embodiment, a polyacrylonitrile precursor is heated to a temperature below 200° C., preferably between about 150° C. and 170° C. in air or other gaseous medium while it is stretched between about 5 and 100% its original length followed by passing it into one or more oxidation ovens at temperatures between about 200° and 300° C. whereat it is optionally stretched once more. In a second embodiment, a similar or preferably smaller denier polyacrylonitrile precursor is used, e.g. below about 0.7 (denier per filament), and it is stretched between zero and 30% (preferably 10 to 25%) its original length while undergoing oxidation in the oxidation ovens at temperatures between about 200° C. and 300° C.

The polyacrylonitrile precursor which is useful in making carbon fiber hereof comprises a polymer that is made by addition polymerization, either in solution or otherwise, of ethenic monomers (i.e. monomers that are ethylinically unsaturated), at least about 80 mole percent of which comprise acrylonitrile. The preferred polyacrylonitrile precursor polymers are copolymers of acrylonitrile and one or more other ethenic monomers. Available ethenic monomers are diverse and include, for example, acrylates and methacrylates; unsaturated ketones; and acrylic and methacrylic acid, maleic acid, itaconic acid and their salts. Preferred comonomers comprise acrylic or methacrylic acids or their salts, and the preferred molar amounts of the comonomer ranges between about 1.5 and 3.5%. (See U.S. Pat. No. 4,001,382 and U.S. Pat. No. 4,397,831 which are hereby incorporated herein by reference.)

The polyacrylonitrile precursor polymers suitable for making carbon fiber hereof are soluble in organic and/or inorganic solvents such as zinc chloride or sodium thiocyanate solutions. In a preferred practice of making a polyacrylonitrile precursor for use in making the carbon fibers hereof, a solution is formed from water, polyacrylonitrile polymer and sodium thiocyanate at exemplary respective weight ratios of about 60:10:30. This solution is concentrated through evaporation and filtered to provide a spinning solution. The spinning solution comprises about 15% by weight of the polyacrylonitrile polymer.

The spinning solution is passed through spinnerets using dry, dry/wet or wet spinning to form the polyacrylonitrile precursor. The preferred polyacrylonitrile precursor is made using a dry/wet spinning wherein a multitude of filaments are formed from the spinning solution and pass from the spinneret through an air gap or other gap between the spinneret and a coagulant preferably comprising aqueous sodium thiocyanate. After exiting from the coagulant bath, the spun filaments are washed and then stretched to several times their original length in hot water and steam. (See U.S. Pat. No. 4,452,860 herein incorporated by reference and Japanese Application 53-24427 [1978].) In addition, the polyacrylonitrile precursor is treated with sizing agents such as silane compounds (see U.S. Pat. No. 4,009,248 incorporated herein by reference).

Figure 24:
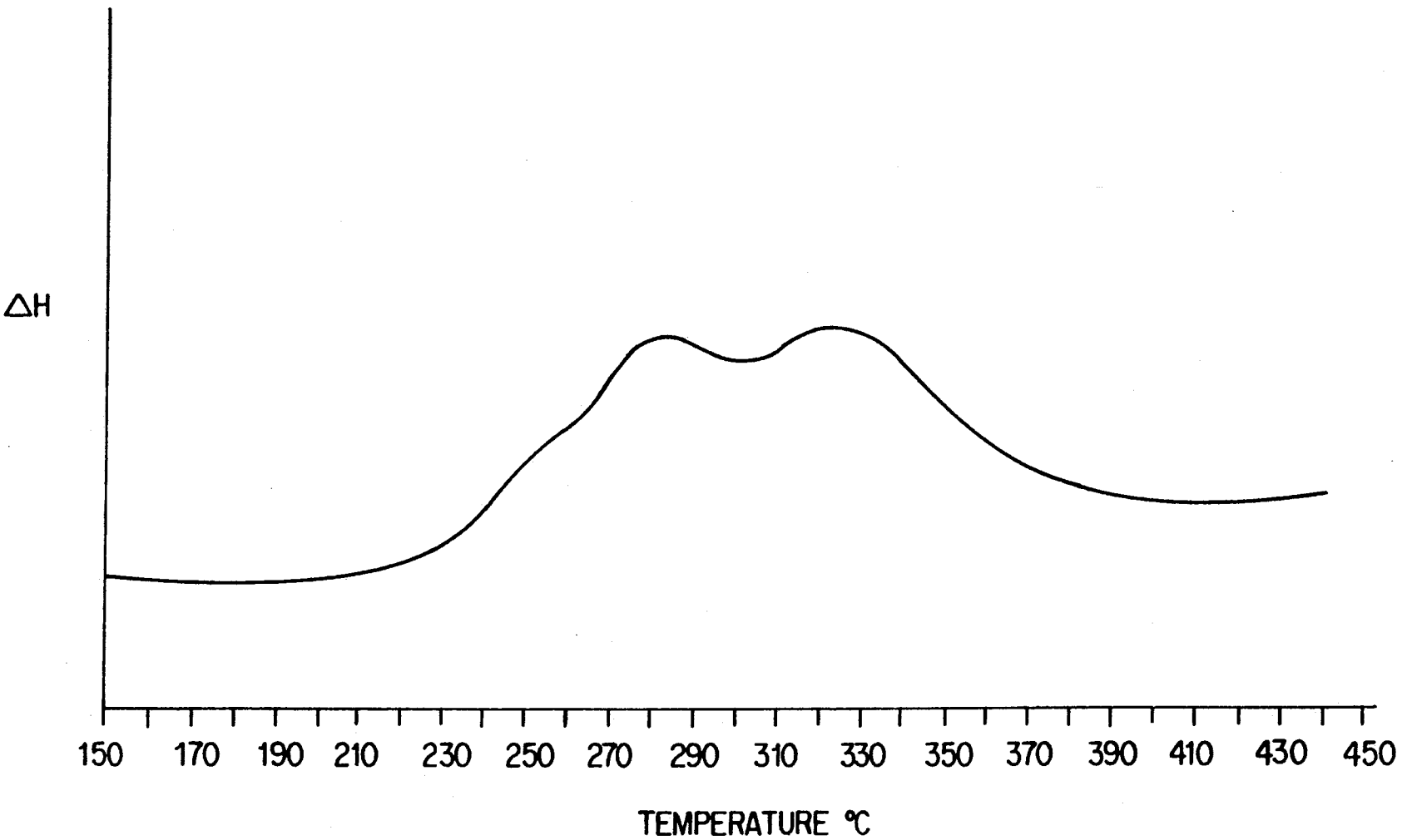
FIG. 24 is a thermal responsive curve for polyacrylonitrile precursor.

The polyacrylonitrile precursor (preferably silane sized) is in the form of tows in bundles comprising a multitude of filaments (e.g. 1,000, 10,000 or more). The tows or bundles may be a combination of two or more tows or bundles, each formed in a separate spinning operation. A thermal response curve in air of a polyacrylonitrile precursor suitable for use in making the carbon fibers of this invention is shown in FIG. 24.

The denier per filament of the polyacrylonitrile precursors desirably ranges between 0.5 and 3.0. The particular denier of the polyacrylonitrile precursor chosen influences subsequent processing of the precursor into carbon fiber hereof. For example, larger denier precursor, e.g. 0.8 denier per filament or above precursor is preferably stretched at temperatures below 200° C. (e.g. about 150°-160° C.) to reduce its denier to less than 0.8 prior to significant oxidation.

Through stretching at temperatures between 100° and 200° C., the resultant precursor is up to 3.5 times or more its original length; and due to the minimal reaction at temperatures within this range may be in amounts selectively calculated in advance to provide the denier desired for subsequent oxidation and stabilization. For example, a 0.8 denier per filament precursor may be stretched 17% to yield a 0.68 denier per filament material by a Stretch Ratio (S.R.) of 1.176 according to the following formula:

$$d_n = \frac{d_s}{S.R.} \text{ where } S.R. \text{ equals } \frac{Lo}{Li}$$

$L_o$ is length out, $L_i$ is length in, $d_S$ is original denier and $d_N$ is new denier. Desired stretch ratio (S.R.) may be achieved by drawing the precursor faster through the desired heated zone (e.g. temperature between 150° C. and 170° C.) that it is permitted to enter this zone.

The polyacrylonitrile precursor is oxidized in one or more ovens maintained at temperatures between 200° C. and 300° C. The polyacrylonitrile precursor is stretched during oxidation.

A variety of oven geometries are known to provide appropriate oxidation in making carbon fiber and any of these ovens may be suitably employed in accordance with this invention. Preferably, however, a series of ovens are employed according to this invention with the precursor that is undergoing oxidation in these ovens passing around rollers positioned in steps on either side of the exterior of each oven. In this way the polyacrylonitrile precursor undergoing oxidation passes through a single oven several times.

After oxidation, the oxidized precursor is passed through a tar removal furnace (also called low temperature furnace) maintained at temperatures (between 400° C. and 800° C.) that increase relative its travel through the furnace. The heat up rate in the low temperature furnace is between 500° and 1000° C./minute. ("Heat up rate" as used herein refers to the rate of temperature increase the fiber undergoes as it passes through an oven or furnace. The rate is an average rate for the fiber as fibers in the middle of an oven or furnace typically are heated faster than those close to the sides.)

The low temperature furnace contains a non-oxidizing atmosphere and is vented of gaseous products resulting from the ongoing carbonization in this furnace. Nitrogen gas nominally at atmospheric pressure is preferred as the non-oxidizing atmosphere and may be used to draw the gaseous products from the furnace through a slight positive pressure thereof.

After exit from the low temperature furnace, the partially carbonized precursor enters a first high temperature furnace. The temperature in this first high temperature furnace is preferably between 1200° C. and 1800° C. and the pressure is nominally atmospheric or slightly above, e.g. up to 20 mm Hg above atmospheric. The heat up rate in this first high temperature furnace is preferably between about 3500° and 5000° C./minute to the first 1000° C.

The precursor undergoing carbonization in the low temperature and first high temperature furnaces is maintained under a tension such that it is between −5% and 20% longer in length after exit from the first high temperature furnace as compared to its length at entry to the low temperature furnace. Preferably, such a change in length is accomplished through stretching the precursor undergoing carbonization primarily in the low temperature (tar removal) furnace. Thus, the fiber which has passed through the tar removal or low temperature furnace is between 1% and 30% longer in length at the exit from such low temperature furnace. A small shrinkage or no shrinkage relative to the precursor undergoing carbonization in the first high temperature furnace is permitted where shrinkage in the first high temperature furnace is defined relative the lengths of the carbonized fiber entering and exiting this first high temperature furnace.

After leaving the first high temperature furnace, the carbonized precursor passes into a second high temperature furnace. The furnace has a temperature between about 1800° C. and 3000° C. The heat up rate of the carbonized precursor fiber to 1800° C. in this second high temperature furnace is between about 1200° C./minute and 4000° C./minute. The carbonized precursor passing through this second high temperature furnace is stretched so that it is between about ½% and 10% greater in length after it has passed through the second high temperature furnace, such increase in length being based on the length of the carbonized precursor (carbon fiber) entering the second high temperature furnace. The second high temperature furnace has a non-oxidizing atmosphere that is preferably nitrogen or the like and kept at a slight positive pressure (e.g. about one atmosphere).

Stretching is accomplished in the second high temperature furnace as well as in the low temperature furnaces and oxidation ovens through use of rollers drawing the filaments at rates greater than the rates driven by the rollers positioned at the entry of the furnace or oven. These rollers may be positioned in at a variety of locations to achieve similar results. Preferably, however, rollers are positioned at the entry and exit of the oxidation ovens, including particularly at entry and exit of the first oxidation oven, if there is more than one oven. Similarly, rollers for stretching the oxidized precursor are positoned at the entry and exit of the tar removal furnace. Still further, in especially preferred embodiments, rollers are positioned for stretching at the entry and exit of the first high temperature and of the second high temperature furnaces.

The rollers at the entry and exit of the first high temperature furnace are desirably adjusted to allow minor shrinkage or keep the carbonized fiber from shrinking in the first high temperature furnace. The rollers at the entry and exit of the second high temperature furnace are adjusted preferably to cause stretching in the second high temperature furnace.

Alternatively, rollers may be positioned for stretching across the span of entry to the low temperature furnace and exit from the second high temperature furnace.

After exit from the second high temperature furnace the carbonized fiber is surface treated. A variety of surface treatments are known in the art. Preferred surface treatment is an electrolytic surface treatment. The preferred electrolytic surface treatment comprises passing the fiber through a bath containing an aqueous sodium hydroxide solution, (0.5–3% by weight). The current is applied to the fiber at between about 1 and 5 columbs/inch of fiber per 12,000 filaments. The resulting surface treated fiber is then preferably sized with an epoxy compatible sizing agent such as Shell epoxy Epon 834.

The following examples are intended to illustrate this invention and not to limit its broader scope as set forth in the appended claims. In these examples, all temperatures are in degrees Centrigade and all parts are parts by weight unless otherwise noted.

EXAMPLE 1

Polyacrylonitrile precursors were made using an air gap wet spinning process. The polymer of the precursor had an intrinsic viscosity between about 1.9 and 2.1 deciliters per gram using a concentrated sodium thiocyanate solution as the solvent. The spinning solution and coagulants comprised an aqueous solution of sodium thiocyanate. The polymer was made from a monomer composition that was about 98 mole % acrylonitrile and 2 mole % methacrylic acid. Table 1 shows the characteristics of the resulting precursor.

TABLE 1

| Precursor Properties | |
|---|---|
| Denier | 0.6 |
| Tensile Strength (g/d) | 6.0 |
| Tensile Modulus (g/d) | 105 |
| DHT (g/d)[1] | 0.168 |
| DHE (%)[2] | 57 |
| Boil-off Shrinkage (%) | 5.8 |
| US Content (%)[3] | 1.14 |
| Sodium Content (ppm) | 558 |
| Residual Solvent (%) | 0.006 |
| Moisture Content (%) | 0.79 |
| Filament Diameter Cv (%) | 4.8 |
| C=N Orientation Function | 0.599 |
| Fiber Density (g/cc) | 1.182 |

[1]Dry heat tension. Procedure described in Appendix III.
[2]Dry heat elongation. Procedure described in Appendix IV.
[3]Sizing content in weight percent.

Table 2 describes the process conditions that yielded carbon fiber having characteristics set forth in Tables 3 and 4. The precursor fiber used in making the carbon fiber had the characteristics shown in Table 1.

TABLE 2

FIBER RUN CONDITIONS

PAN Type: 0.6 dpf 12k
OXIDATION CONDITIONS:
Oxidation Oven No. 1 - 65 minutes at 233° C.
Oxidation Oven No. 2 - 106 minutes at 236° C.
Oxidation Stretch = 9.2%
LOW TEMPERATURE FURNACE (LTF):
6 Equal Zones
Zone Temperature Setpoints:
Zone 1 - 450° C.
Zone 2 - 610° C.
Zone 3 - 710° C.
Zone 4 - 600° C.
Zone 5 - 500° C.
Zone 6 - 450° C.
LTF Residence Time = 5.2 minutes
LTF Initial Heat-up rate = 630° C./min
Fiber Stretch in LTF = +9.8%
HIGH TEMPERATURE FURNACE (HTF):
1 Zone
Temperature Setpoint = 1750° C.
HTF Residence Time = 2.0 minutes
HTF Initial Heat-up Rate (to 1000° C.) = 4240° C./min
Fiber Stretch in HTF = −4.1%
HIGH MODULUS FURNACE (HMF):
1 Zone
Temperature Setpoint = 2600° C.
HMF Residence Time = 1.6 minutes
HMF Initial Heat-up Rate (to 1000° C.) = 2675° C./min
Fiber Stretch in HMF = +2.6%
CALCULATED OVERALL STRETCH THROUGH THE THREE FURNACES = +7.4%
SURFACE TREATMENT:

TABLE 2-continued

| FIBER RUN CONDITIONS |
|---|
| Electrolyte: Aqueous 1.0% by weight NaOH solution<br>Current = 110 Amps<br>Voltage = 12 V DC<br>Surface Treatment Level per Tow = 2.85 coul/in per 12000 filaments. |

-continued

| Temperature | Time (min.) |
|---|---|
| 249° C. | 16 |

where the precursor passed through air ovens during this oxidation. The oxidized precursor was 105% longer after exit from the oxidation ovens.

TABLE 3

FIBER TOW TESTING
Made from 0.6 dpf PAN of Table 1

| Overall Carb. Stretch % | Fiber Density lb/in$^3$ | Fiber WPUL lb/in × $10^{-6}$ | Tensile Strength ksi | Tensile Modulus ½ load | Tensile Modulus 6-1 secant | Tensile Elongation % |
|---|---|---|---|---|---|---|
| +12% | .0675 | 17.19 | 702 | 68.8 | 66.7 | 1.08 |
| 10% | .0675 | 17.53 | 663 | 66.1 | 64.3 | 1.06 |
| +8% | .0675 | 18.20 | 660 | 66.0 | 63.8 | 1.05 |
| | .0675 | 17.81 | 700 | 65.7 | 64.1 | 1.11 |
| +5% | .0670 | 18.42 | 656 | 66.3 | 63.7 | 1.04 |
| +3% | .0674 | 18.89 | 637 | 64.7 | 63.0 | 1.03 |
| +0% | .0676 | 20.04 | 647 | 63.9 | 62.4 | 1.04 |
| −5% | .0673 | 19.97 | 510 | 59.7 | N/A | .90 |
| | .0672 | 21.10 | 497 | 59.9 | 59.1 | .82 |

Note:
−5% fiber is surface treated. All others are unsurface treated.

TABLE 4

CARBON FIBER
Fiber Surface Treated in
1.0% (by weight) NaOH at 2.8 coul/inch
per 12,000 filaments

| Carbonization Stretch | +8% | 0% | −5% |
|---|---|---|---|
| Fiber Density, lb/in$^3$ | .0675 | .0677 | .0671 |
| Fiber weight/length, lb/in × $10^{-6}$ | 17.99 | 19.35 | 21.33 |
| Tow Testing | | | |
| Tow Tensile Strength, ksi | 615 | 598 | 507 |
| Tow Tensile Modulus, Msia | 65.9 | 61.5 | 58.8 |
| Tow Elongation, % | 1.08 | 1.01 | .91 |
| Laminate Testing - 3501-6 Resin | | | |
| Tensile Strength, ksi* | 522 | 515 | 274 |
| Tensile Modulus, Msi* | 64.9 | 60.4 | 56.2 |
| Tensile Elongation, % | .82 | .85 | .50 |
| Flex Strength, ksi** | 176 | 167 | 164 |
| Flex Modulus, Msi** | 31.6 | 31.5 | 29.1 |
| Compression Strength, ksi** | 150 | n/a | 147 |
| Short Beam Shear Strength, ksi | 12.2 | 9.4 | 11.2 |
| Unidirectional CTE[b], in/in/°F. × $10^{-6}$ | −.35 | — | −.45 |

*Normalized to 100% fiber volume.
**Normalized to 62% fiber volume.
[a]Half Load Tangent Modulus.
[b]Coefficient of thermal expension.

EXAMPLE 2

Carbon fiber of this invention was made from a polyacrylonitrile precursor made to have properties shown in Table above.

Figure 19:
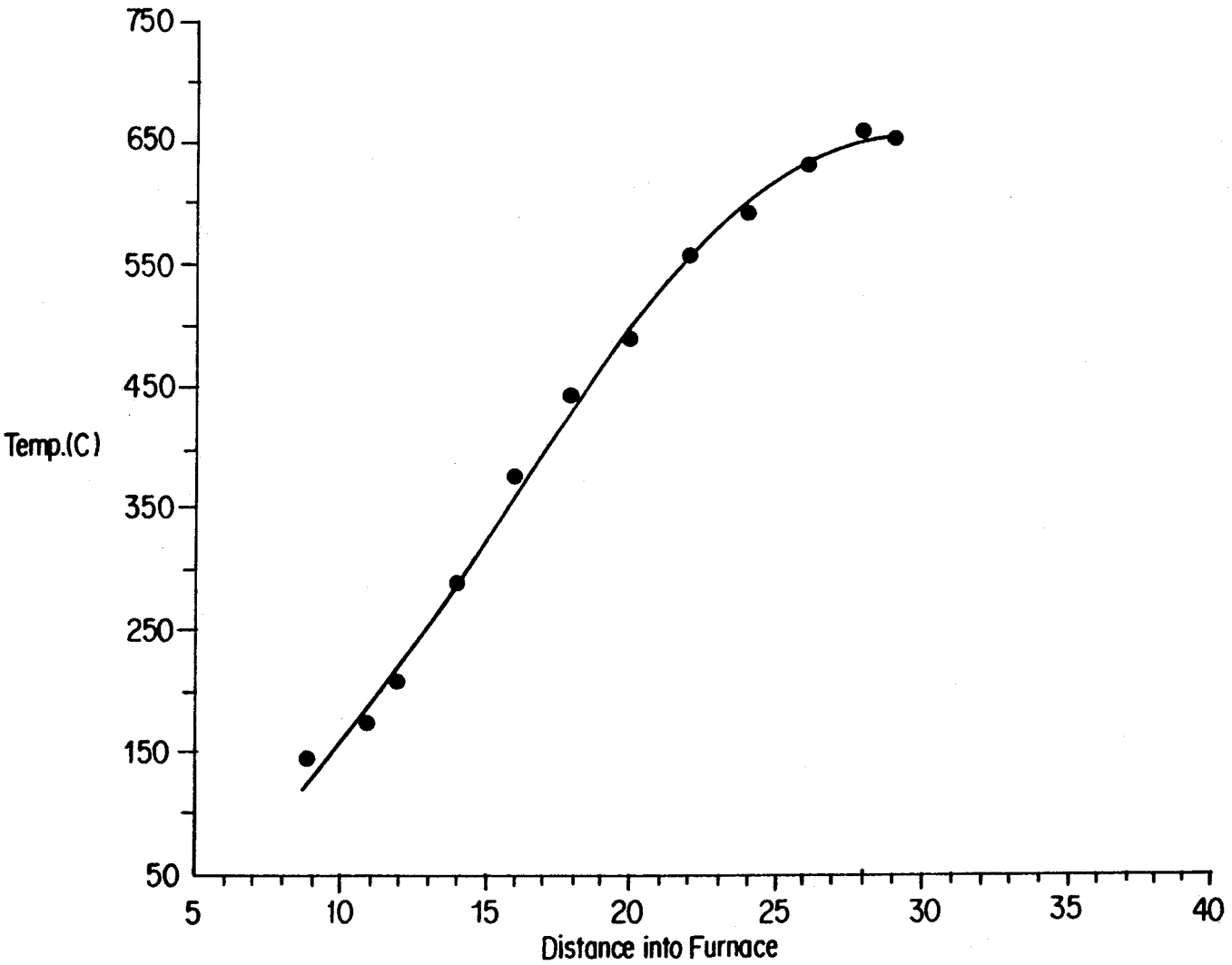
FIGS. 19 and 20 illustrate temperature profiles of furnaces used in producing carbon fiber described in certain of the examples of this invention. In particular.
Figure 20:
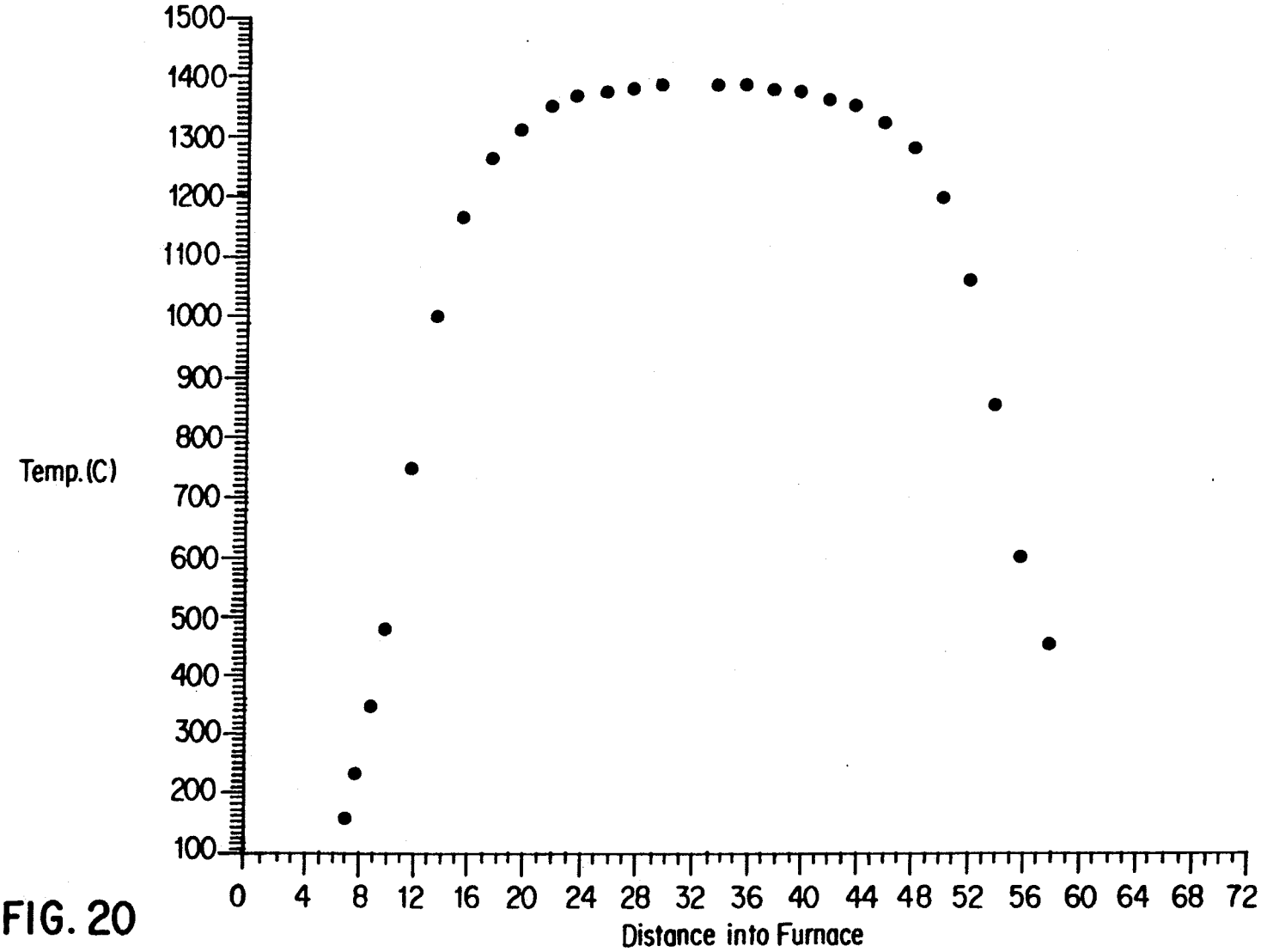

The temperature profiles of the low temperature (tar removal) and first high temperature furnaces are shown in FIGS. 19 and 20. In FIG. 19, the furnace settings are as follows: Zone 1=50° C., Zone 2=650° C. and Zone 3=111° C.

The time spent at temperature during initial processing of the precursor was as follows:

| Temperature | Time (min.) |
|---|---|
| 158° C. | 4 |
| 234° C. | 72 |

The processing undertaken in the low temperature first and second high temperature furnaces is illustrated below in Table 5. Runs R and S were made using the oxidized precursor described in this Example 2. Table 6 shows the tensions (in grams) of the fiber undergoing oxidation and undergoing carbonization in the first low temperature furance. The tensions were measured by strain gage transducers.

TABLE 5

(% ELONGATION)

| Furnace | R | S |
|---|---|---|
| Low[1] | 13.3 | 15.5 |
| First High[2] | −4.4 | −4.4 |
| Second High[3] | +1.1 | 1.2 |
| Overall | +9.4 | +11.8 |

[1]See FIG. 19.
[2]1300° C. Maximum Temperature.
[3]2500° C. Maximum Temperature.

TABLE 6

(TENSIONS IN GRAMS)

| Run | R | S |
|---|---|---|
| Oxidation | 2613 | 2613 |
| Low Temperature Furnace | 1041 | 1116 |

The properties of the carbon fiber resulting from Runs R and S are shown below in Table 7.

TABLE 7*

| Run | Modulus (psi × 106) | Tensile Strength (psi × 103) | Density (gm/cm) |
|---|---|---|---|
| R | 60.2 | 673 | 1.805 |
| S | 62.5 | 571 | 1.812 |

*Properties measured according to procedures shown for Tow Test like that shown in Appendices.

EXAMPLE 3

In this example, a 0.8 denier precursor was used. The properties of this 0.8 denier precursor are shown in Table 8. Oxidation and stretching was similar to that described in Example 2.

TABLE 8

| DPF (NOMINAL) Precursor Properties | |
|---|---|
| Tow Denier (g/9000 m) | 9,570 |
| Tow Tenacity (g/d) | 5.6 |
| Tow Modulus (g/d) | 102 |
| DHT (g/d) | 0.166 |
| Boil-off Shrinkage (%) | 5.7 |
| US COntent (%) | 0.88 |
| Sodium Content (ppm) | 568 |
| Residual Solvent (%) | 0.0073 |
| Moisture Content (%) | 0.60 |
| Filament Diameter Cv (%) | 4.4 |
| Monster Filaments | 0 |

Processing details used after oxidation and the mechancial properties (Tow Test) of the resultant carbon fibers are shown in Table 9, below.

TABLE 9

| Run | C1[2] Temp (°C.) | C2[3] Temp (°C.) | Overall Stretch TR[1]/C1[2]/C2[3] Planned % | Actual % | TR[1] (%) | C1[2] (%) | C2[3] (%) | T.S. (Msi) | E. (MMsi) | Density (g/cc) |
|---|---|---|---|---|---|---|---|---|---|---|
| 65-3 | 1300 | 2780 | 5 | 3.8 | 7.3 | −4.7 | 1.5 | 533 | 65.6 | 1.88 |
| 65-4 | 1300 | 2780 | 7 | 7.1 | 8.8 | −4.6 | 3.2 | 490 | 59.6 | 1.77 |
| 67-1 | 1300 | 2780 | 1.0 | 2.4 | 7.9 | −0.4 | 443 | 62.2 | 1.86 | |

[1]Low Temperature Furnace (tar removal)
[2]First High Temperature Furnace
[3]Second High Temperature Furnace

EXAMPLE 4

In this example, a series of carbon fiber was made starting from 0.8 denier polyacrylonitrile precursor. The precursor had properties like that shown in Table 8. Table 10 shows the properties of the resultant carbon fiber and the process conditions used in making the carbon fiber with these properties.

TABLE 10[a]

| Run | Oxidation Stretch | TR Stretch | C1 Stretch | C2 Stretch/Temp | Fiber Properties Tensile Msi | Modulus MMsi | Density g/cc |
|---|---|---|---|---|---|---|---|
| 155-3 | 17% | 1.1% | −5.1% | 0.9%/2500° C. | 626 | 60.0 | 1.836 |
| 155-4 | 17 | −3.0 | −5.2 | 0.9/2500 | 635 | 59.6 | 1.837 |
| | 17 | 3.5 | −5.0 | 0.9/2500 | 595 | 58.5 | 1.843 |
| 57-2s | 20 | 4.0 | −4.7 | 0.9/2600 | 488 | 59.3 | 1.828 |
| 57-4s | 20 | 8.8 | −4.6 | 1.1/2600 | 616 | 63.4 | 1.832 |
| 57-5s | 20 | 10.4 | −4.6 | 1.1/2600 | 617 | 61.7 | 1.831 |
| 59-1s | 20 | 8.7 | −4.6 | 1.5/2700 | 525 | 67.4 | 1.868 |

[a]See Table 9 for meaning of TR, C1 and C2.

EXAMPLE 5

In this example, a 0.6 dpf polyacrylonitrile precursor was used in making carbon fiber. The properties of the 0.6 denier precursor are like those shown for the precursor fiber of Example 1. The conditions used in making the carbon fiber and the resultant properties of the carbon fiber are shown in Table 11, below.

EXAMPLE 6

Polyacrylonitrile precursor was made generally according to the conditions previously described except that it had no steam stretching and its denier was 1.2 dpf. The 1.2 dpf. polyacrylonitrile precursor fiber was stretched 100% its original length at a temperature of 158° C. and wound around a spool and stored.

The precursor was then oxidized by passing it through air circulation ovens at temperatures for the times shown in the following Table 12.

TABLE 12

| Temperatures | Time (minutes) |
|---|---|
| 158° C. | 2.05 |
| 240° C. | 17.73 |
| 245° C. | 14.43 |
| 248° C. | 17.72 |
| 250° C. | 17.72 |
| 250° C. | 4.43 |

The oxidized precursor passed from the last oxidation oven through a low temperature (tar removal) furnace having a temperature profile like that shown in FIG. 20. Then the partially carbonized fiber passed through a first low temperature furnace held at 1425° C. and then a second high temperature furnace held at 2500° C.

The stretch in each of the low temperature, first high and second high temperature furnaces are shown (values are %) for four distinct runs in Table 13 below.

TABLE 13

| Run | Overall | TR | C1 | C2 |
|---|---|---|---|---|
| 135-1 | 0.1 | 4.5 | −5.3 | 0.9 |
| 135-2 | 2.4 | 6.9 | −5.1 | 0.9 |
| 135-3 | 4.9 | 9.3 | −5.0 | 1.0 |

TABLE 11[a]

| Run | Oxidation Stretch | Carbonization C1 Temp. | C2 Temp. | C.F. Properties at TR/C1/C2 Stretch (%) 0%[b] | 2½%[b] | 5%[b] | 7½%[b] | 10%[b] | 12½%[b] | 15% | 17½%[b] | 20%[b] |
|---|---|---|---|---|---|---|---|---|---|---|---|---|
| 161-1 8 | +5% | 1300° C. | 2000° C. | 652/49.0 | 660/51.8 | 654/51.7 | 686/52.2 | 713/54.1 | 722/53.2 | — | 707/54.1 | 737/55.1 |
| 161-1 9 | +5% | 1300° C. | 2500° C. | 520/56.3 | 585/56.6 | 646/57.7 | 614/58.6 | 673/60.2 | 671/62.5 | 681/64.8 | 560/62.2 | 621/63.5 |

[a]See Table 9 for meaning of TR, C1 and C2.
[b]Calculated based on length exiting C2 oven length entering TR.

TABLE 13-continued

| Run | Overall | TR | C1 | C2 |
|---|---|---|---|---|
| 135-4 | 6.9 | 11.3 | −4.1 | 0.2 |

Table 14, below, shows the properties of carbon fiber made according to the procedures of this example.

TABLE 14

| Run | Modulus[a] | Tensile Strength[b] Density |
|---|---|---|
| 135-1 | 58.2 | 606 |
| 135-2 | 60.1 | 615 |
| 135-3 | 61.5 | 628 |
| 135-4 | 61.4 | 558 |

[a]$10^6$ psi
[b]$10^3$ psi

APPENDIX I

Test Methods (Including Impregnated Strand Test) for Determining Physical Properties of Carbon Fiber Tows

1. SCOPE.

Test methods for determining the density, weight per unit length, ultimate tensile strength (Impregnated Strand Test), Young's modulus of elasticity (Impregnated Strand Test), ionic impurities, and size content of tows of carbon fiber.

2. EQUIPMENT AND DOCUMENTS.

2.1 Drawings

Figure 2:
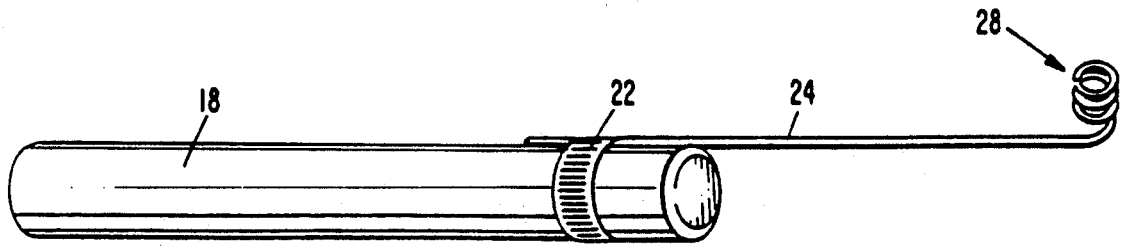

FIG. 1 schematically depicts impregnation of tow 10 of carbon fiber in accordance with the Impregnated Strand Test. Resin solution 12 is in pan 14. Pan 14 is carried on base 16 to which is mounted stand 17. Clamp 20 mounts cross member 18 to stand 17. Clamp 22 mounts wire coil 24 to cross member 18. Clamp assembly 26 carries tow 10 so it can be drawn from resin solution 12 through coil 28 of wire coil 24. FIG. 2 further details cross member 18, wire coil 24 and coil 28. The wire of wire coil 24 is 0.060 inches in diameter. The inner diameter of coil 28 is 0.050 inches.

Figure 3A:
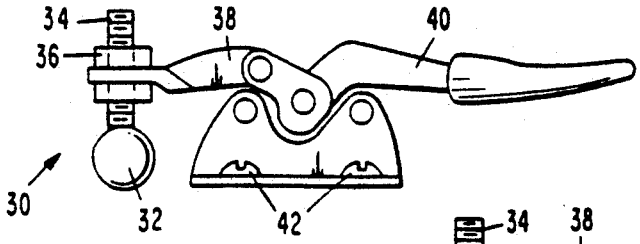
Figure 3B:
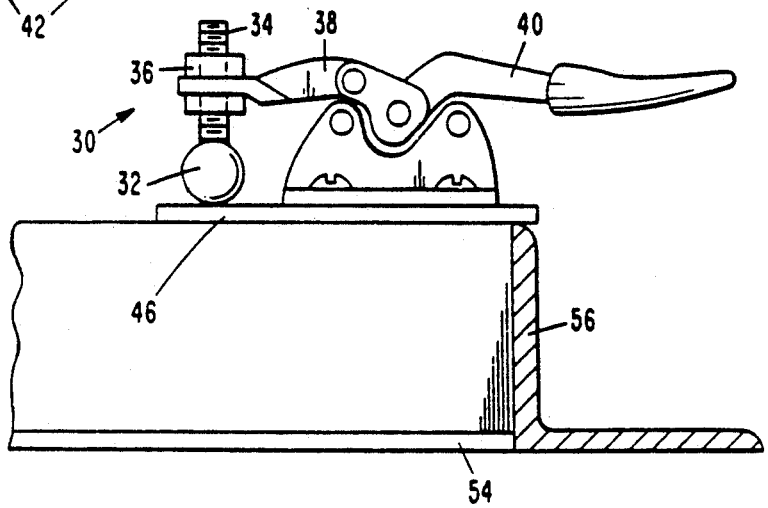
Figure 4A:
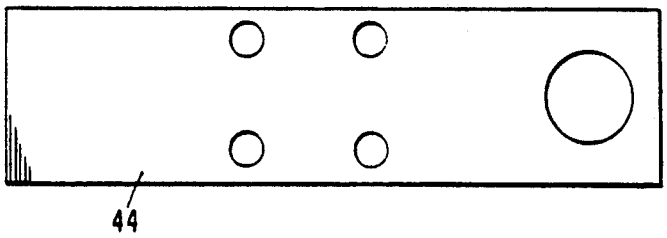
Figure 4B:
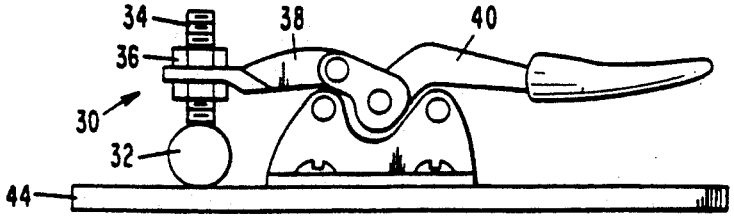
Figure 4C:
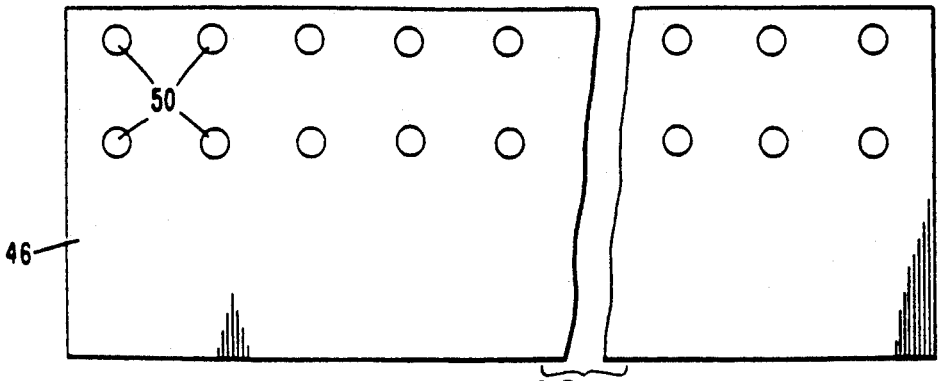
Figure 4D:
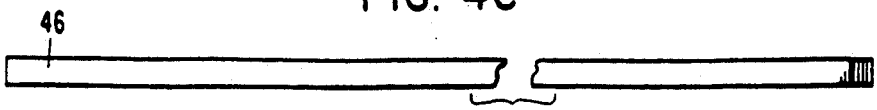
Figure 5A:
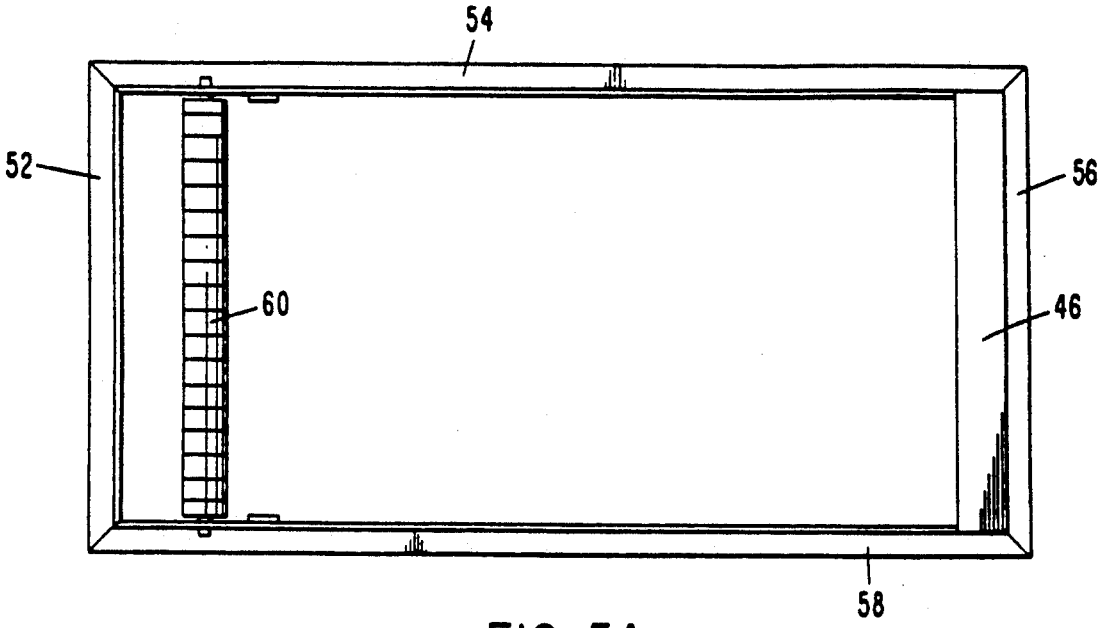
Figure 5B:
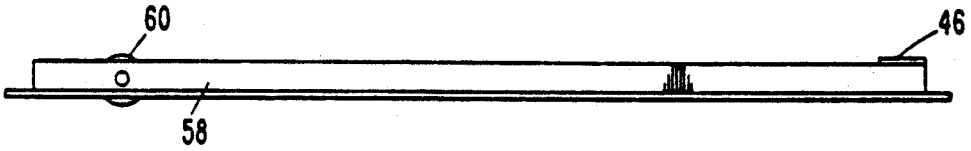
Figure 5C:
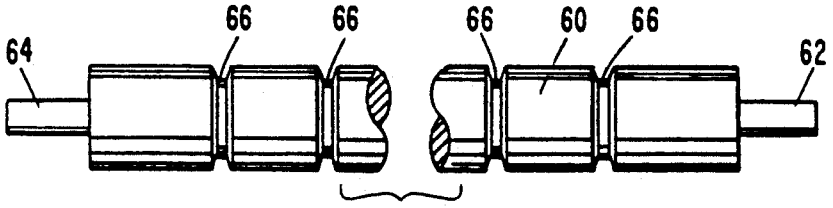
Figure 5D:
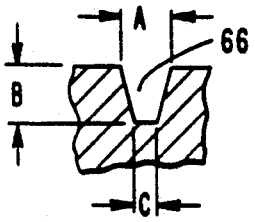

FIGS. 3 (A) and 3 (B), 4 (A) through 4 (D) and 5 (A) through 5 (D) illustrate the specimen curing rack and clamps used therewith for hanging and curing resin impreganted tows of carbon fiber. FIG. 3 (A) shows clamp 10 which corresponds to the clamping device of clamp assembly 26 of FIG. 1. Clamp 30 has adjustable clamp rod 32 which binds the tow of carbon fiber to the base (not shown) on which clamp 30 is mounted. Threaded member 34 is movable through nut 35 mounted on lever arm 38 for adjusting rod 32. Manual activator arm 40 causes lever arm to rotate in clamping the tow of carbon fiber with adjustable clamping arm 38. Bolts 42 bolt clamp 30 to its base.

Clamp 30 can mount to either long base 44 (FIGS. 4 (A) and 4 (B)) or short base plate 46 (FIG. 3 (B)). Short base plate 46 is welded to frame 48 (FIGS. 5 (A) and 5 (B)) of the specimen curing racks through four holes 50 in the short base plate. Base plate 46 can accommodate several clamps for permanent mounting to frame 48.

Frame 48 (FIGS. 3 (B) and 5 (A) and (B)) is made of aluminum and is rectilinear. Frame 48 comprises aluminum angles 52, 54, 56, and 58 which are welded together at their ends.

FIGS. 5 (A) and 5 (B) are respective top and side view of frame 46 of the specimen curing rack. Supports (not shown) mounted on the bottom of frame 46 permit the specimen curing rack to be carried and spaced from a laboratory bench (not shown).

Cylindrical rod 60 is mounted to frame 46 through metal dolls 62, 64. Cylindrical rod 60 is made of aluminum and has grooves 66 (25 in rod 60) which are Teflon ® coated. FIG. 5 (D) is a cross section of a groove 66.

The dimensions (a), (b) and (C) in FIG. 5 (D) are 0.10 inch, 0.15 inch and 0.05 inch respectively.

Figures 6A, 6B, 6C, 6D, 6E:
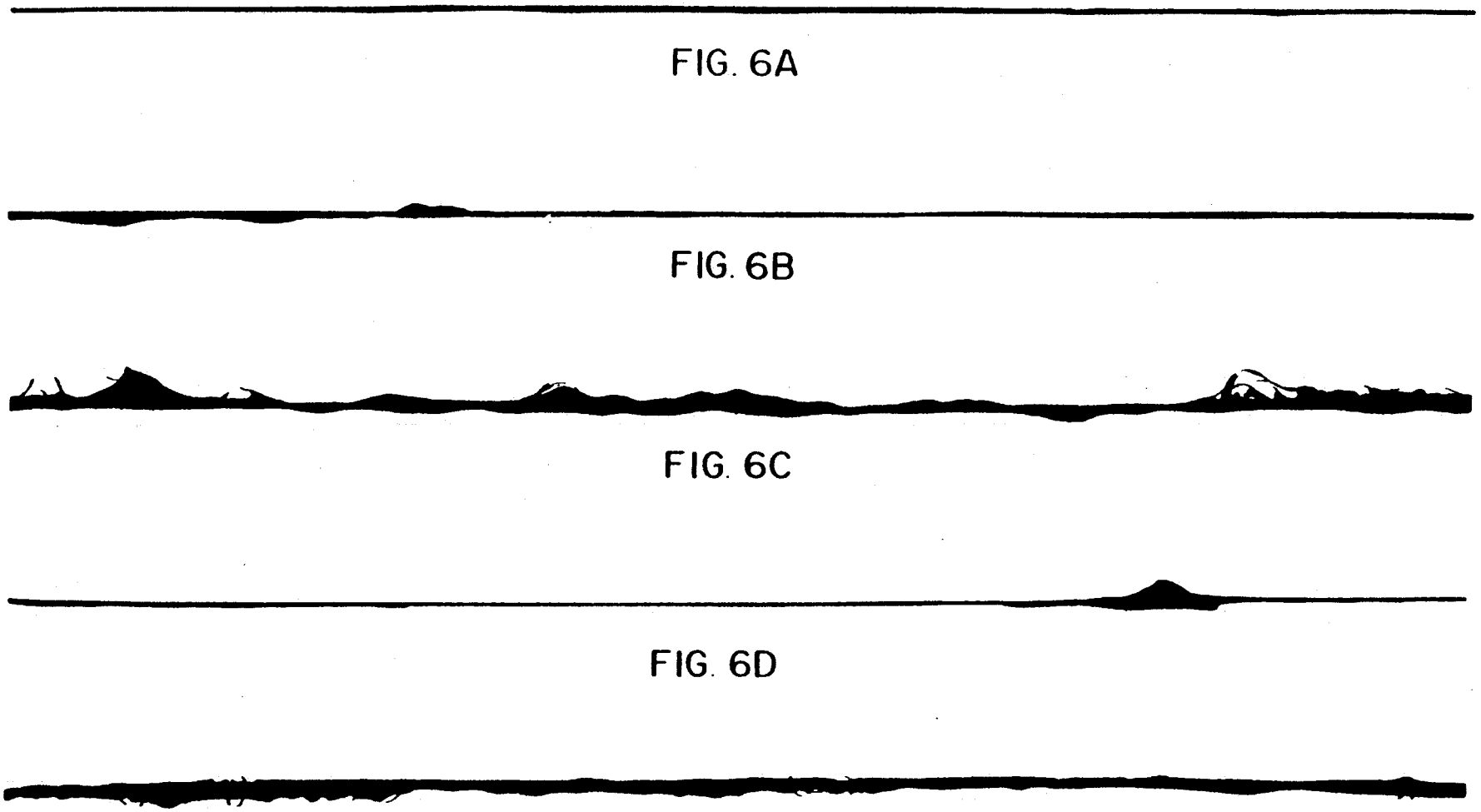

FIGS. 6 (A) through (E) illustrate impregnated tows of carbon fiber. FIG. 6 (A) shows a well collimated tow which can be used to finish test. FIG. 6 (B) shows a tow with some catenary which can be cut to permit use of well collimated portion. FIG. 6 (C) shows tow having extreme catenary which is to be discarded entirely. FIG. 6 (D) shows tow having cut filaments in gauge length and is to be discarded entirely. FIG. 6 (E) shows tow having extreme fuzziness to be discarded entirely.

Figure 7A:
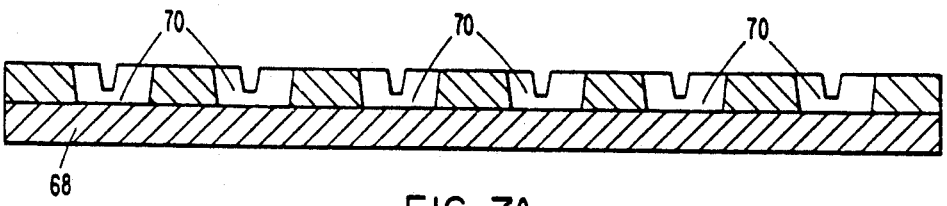
Figure 7B:
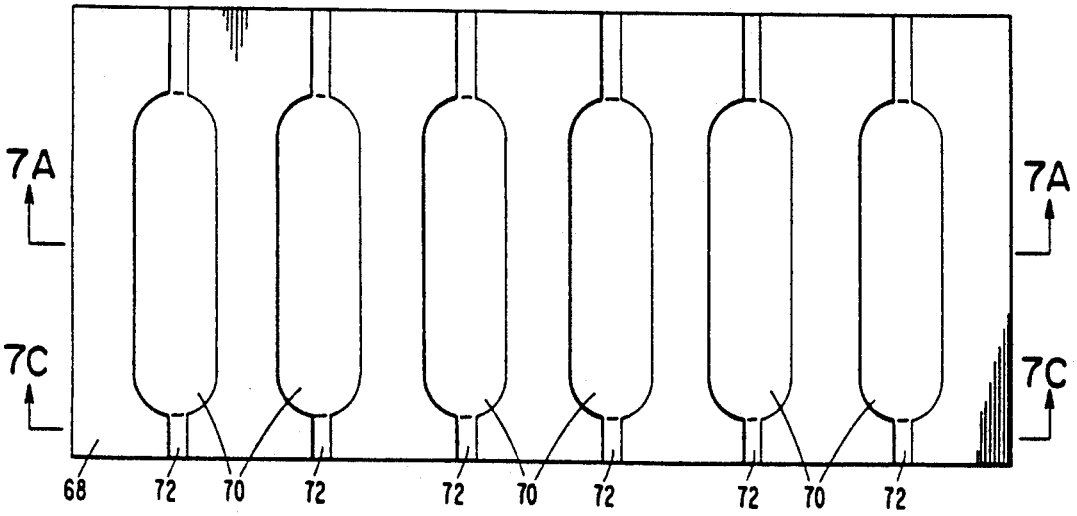
Figure 7C:
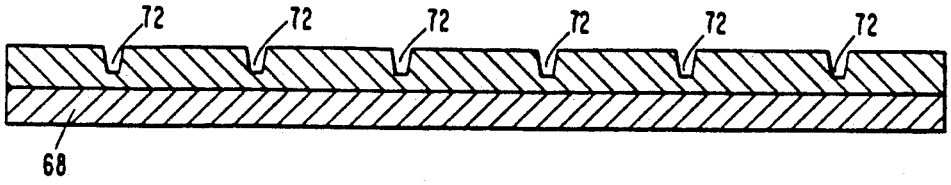
Figure 9A:
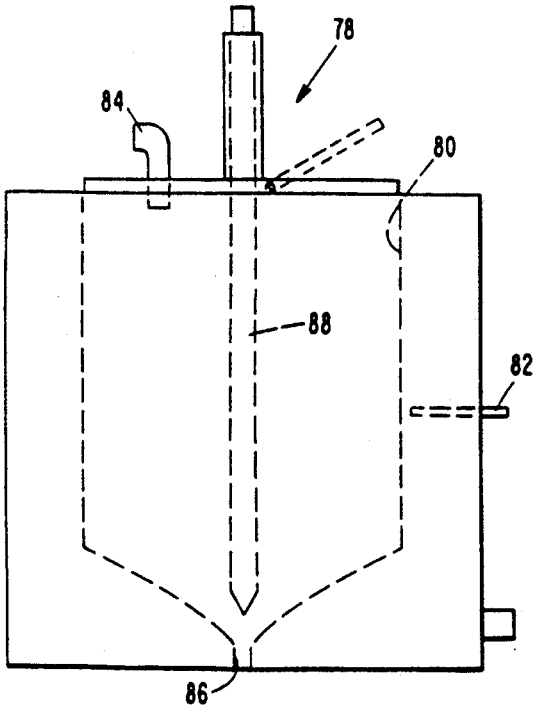
Figure 9B:
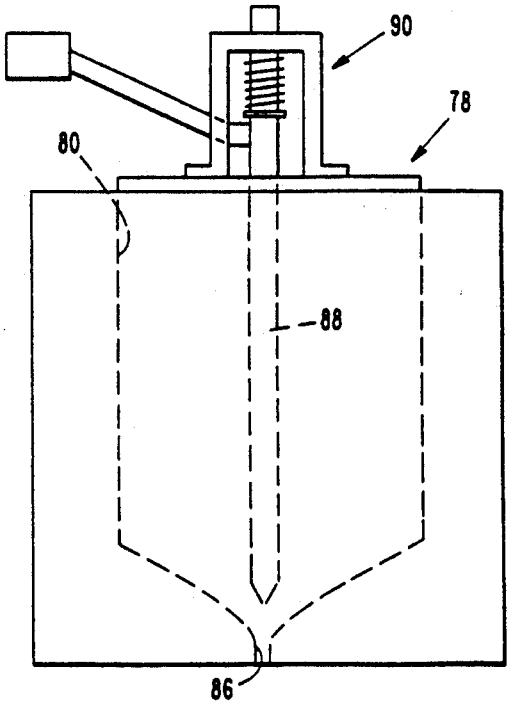

FIGS. 7 (A), (B), and (C) show schematically a specimen tab mold 68 in three view, 7 (A) taken at A—A of FIG. 7(B) and 7 (C) taken at C—C of FIG. 7 (B). Tab mold 68 has tab troughs 70 into which is poured resin from resin dispenser 75 (FIG. 9). Troughs 70 have a $6°\pm2°$ angle in their walls shown by x in FIG. 6 (A). Troughs 70 are $\frac{3}{8}\pm1/64$ inch wide at the top and $2.125\pm0.01$ inch long with a radius of 7/32 at grooves 72.

Figure 8A:
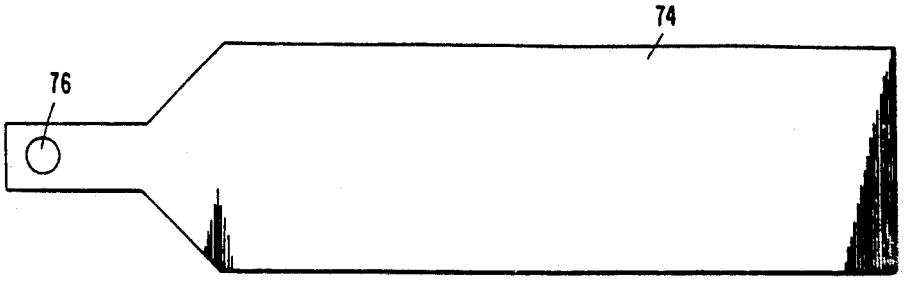
Figure 8B:
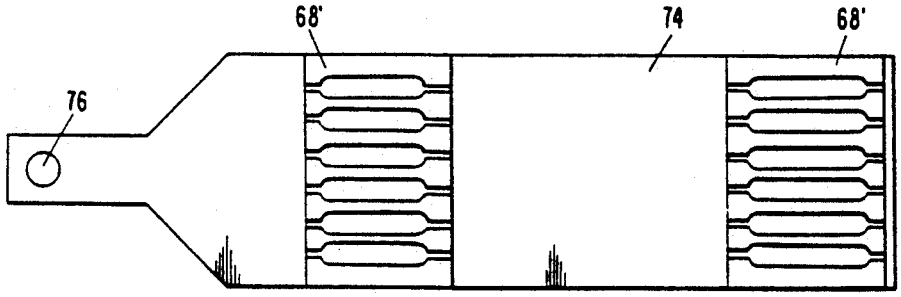
Figure 8C:
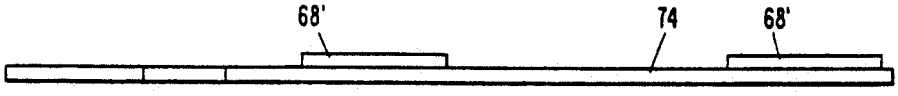

FIGS. 8 (A), (B), and (C) illustrate schematically carrier plate 74 which carried two tab molds 68, 68' as described in connection with FIG. 7. Carrier plate 74 has orifice 76 for mounting plate 74 in the oven. Tab molds 68', 68' are spaced $5.0\pm0.01$ inches apart on carrier plate 74 and permanently affixed thereto.

FIG. 9 shows schematically resin dispenser 75 having heating block 78 in front (A) and side (B) views. Heating block 78 has cavity 80 for carrying molten resin heated by heating coils with heating block 78. Temperature probe 82 is mounted within heating block 78 and sensing temperature for a temperature control unit for heating block 78. The resin in cavity 80 is kept under nitrogen, the inlet therefor being shown as 84.

Resin cavity 80 communicates with $\frac{1}{4}''$ orifice 86 at the bottom of heating block 78 for dispensing resin into cavities 70 (FIGS. 7 and 8) of the tab mold part. Dispenser pin 88 moves in and out of orifice 86 in response to movement of spring loaded filling lever assembly 90.

Figure 10:
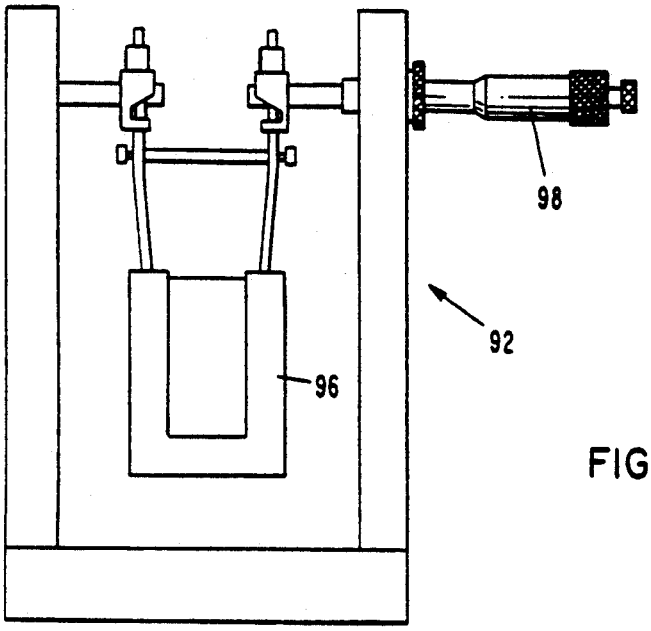
Figure 11:
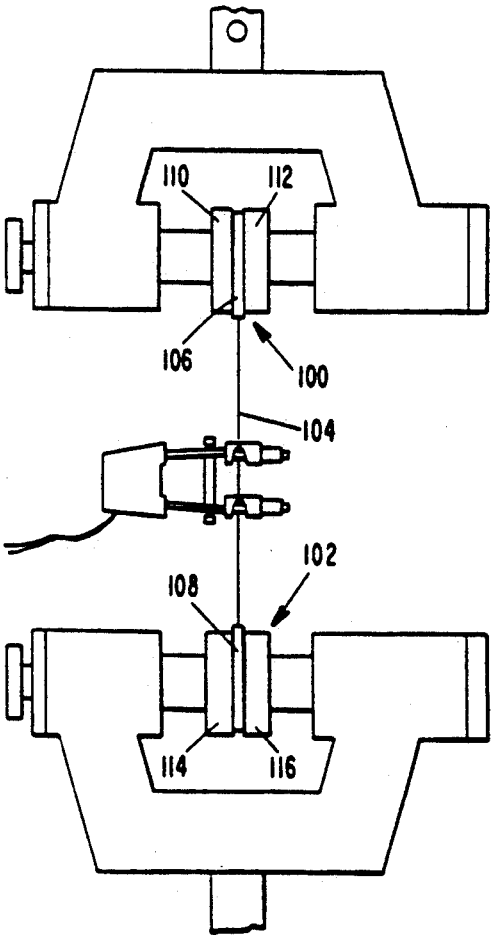

FIG. 10 schematically shows the extensometer calibration fixture 92 comprising stand 94, extensometer 96 and micrometer 98. FIG. 11 shows schematically the grips 100, 102, pneumatically controlled, and tensile specimen 104 having end tabs 106, 108. End tabs 106, 108 fit between grip faces 110, 112, 114, and 116 respectively.

Figure 12:
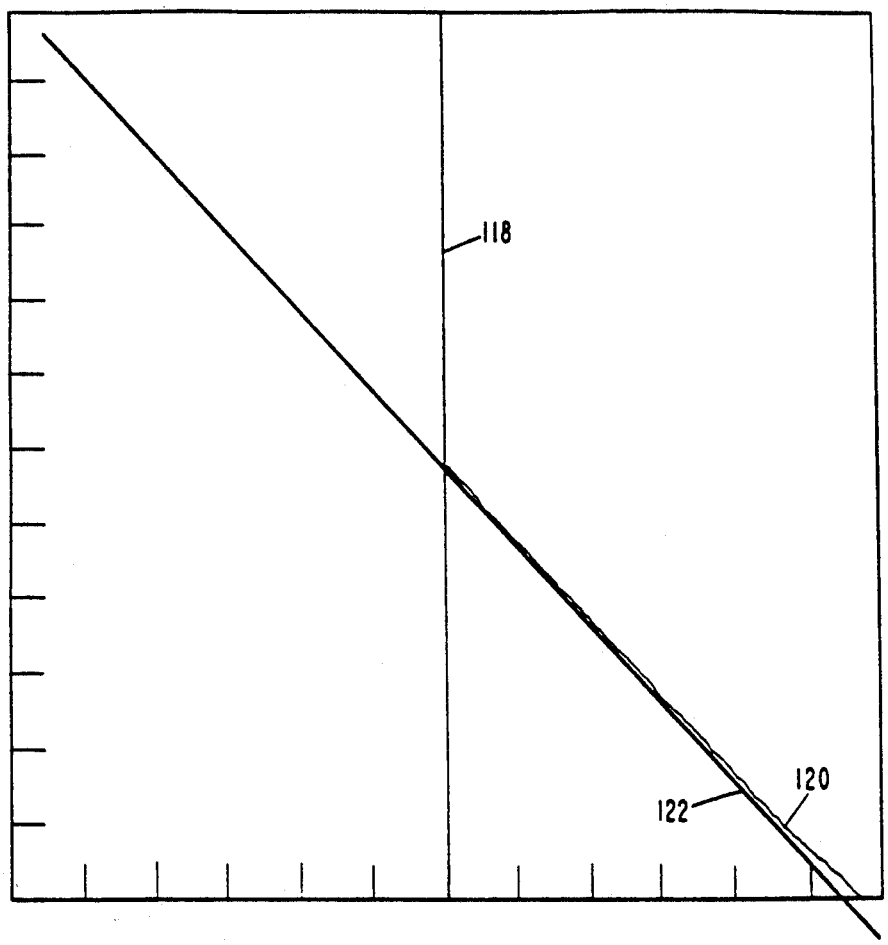

FIG. 12 shows a typical elongation curve having breaking load 118, stress, strain curve 120 and tangent line 122 drawn tangent to curve 120 at point approximately one-half of the breaking load 118.

2.2 American Society for Testing and Materials

ASTM D 638-68 Tensile Properties of Plastics.

3. PROVISIONS 3.1 Equipment calibration.

Testing instrumentation and equipment shall be calibrated in accordance with applicable suppliers operating instructions or manuals and requirements of the test facility.

4. MATERIALS AND EQUIPMENT.

| | Description* |
|---|---|
| Materials | |
| Tonox 6050 | Amine Blend |
| ERL 2256 Resin | Epoxy Resin |
| DER 330 | Epoxy Resin, Dow Chemical |
| DER 332 | Epoxy Resin, Dow Chemical |
| $BF_3MEA$ | Boron Trifloride monoethanol amine, Miller-Stevenson |
| Methanol | ACS Reagent Grade |
| Methylene Chloride | ACS Reagent Grade |
| Resin | Versalon 1200 (General Mills), or equivalent Macromelt 6300 |
| Solvent | Toluene, Reagent Grade |
| Rubber | .85 ± .20 × .85 ± 20 × .03 ± .01 |
| Nitrogen | 0.01N, Type SS-1, Beckman Instrument Co., or equivalent |
| Methyl ethyl ketone (MEK) | ACS Reagent Grade |
| Release agent | Carr #2, or equivalent |
| Equipment | |
| Toggle clamps | FIG. 3, 4 |
| Rack, specimen curing | FIG. 5 |
| Heating block, resin | FIG. 9 |
| Melting pot, resin | FIG. 9 |
| Grips, specimen | FIG. 11 |
| Specimen mold | FIG. 7, 8 |
| Specimen-preparation equipment | FIG. 1, 2 |
| Pycnometer | Hubbard Type, or equivalent |
| Forced air oven | Blue M Power-O-Matic 60 (Blue M Electric Co.) Blue Island Illinois, equivalent |
| Extensometer | Instron Catalog Number (no.) G-51-11 |
| Balance | Analytical balance, Mettler B-5, or equivalent |
| Vacuum desiccator | Pyrex, A. H. Thomas catalog no. 4443, or equivalent |
| Vacuum source | Water aspirator or air pump, A. H. Thomas catalog no. 1038-B, or equivalent |
| Centrifuge | International Clinic Centrifuge Model CL, or equivalent |
| Constant temperature bath | Capable of maintaining 25° C. ± 0.1° C. (± 0.2° F.) |
| Thermometer | Graduated in 0.1° C. subdivisions |
| Tensile tester | Instron, floor model, Model FM, or bench model |
| Wire coil | FIG. 2 |
| Conductivity meter | |
| Conductivity cell | 0.1 cell constant |
| Extraction flask | 500 ml, ground joint |
| pH meter | |
| Oven | Capable of maintaining 163° C. ± 3° C. |

NOTE:
Equipment shown on applicable drawings is also required.
*(Unless otherwise indicated, source is commercial.)

5. TEST PROCEDURES 5.1 Determination of tow density.

The tow density shall be determined in accordance with the following:

5.1.1 Calibration of pycnometer. The pycnometer shall be calibrated as follows:

a. Clean the pycnometer thoroughly using sodium dichromate cleaning solution.
b. Dry the interior by rinsing it successively with tap water, distilled water, and either alcohol and ether or acetone.
c. Expel the solvent vapors with a current of air which has been passed through absorbent cotton and Drierite. Do not subject pycnometer to any considerable elevation of temperature.
d. Prior to weighing, wipe the entire pycnometer first with a piece of clean moist cloth and then with a dry cloth. Weigh the empty pycnometer immediately.
e. Carefully fill the pycnometer with freshly boiled distilled water which is slightly below the temperature of the bath.
f. Insert the pycnometer plug with a rotary motion to avoid the inclusion of air bubbles and then twist until it seats firmly but not so tight that it locks.
g. Place the pycnometer in a constant temperature bath maintained at 25°±0.1° C. Leave the pycnometer in the bath at least 30 minutes.
h. Check the bath to be certain the temperature has not changed. Then remove the pycnometer from the bath and wipe the excess water from the top of the plug using one stroke of the hand or finger.
i. Wipe the surface of the pycnometer with absorbent material giving special attention to the joint where the plug enters the pycnometer.
j. At this point, examine the pycnometer to be certain that it is entirely filled with water. (If any air bubbles are present, fill the pycnometer again and replace it in the bath.)
k. Remove the pycnometer from the bath and wipe the entire surface with a piece of clean moist cloth and then with a dry cloth. Special attention should be given to the area around the joint where the plug enters the pycnometer. Weigh the pycnometer immediately.

5.1.2 Density determination. The density of the tow shall be determined as follows:

NOTE: Sizing must be removed from sized tow prior to the density determination.

a. Accurately weigh enough of the sample into the pycnometer to fill the pycnometer approxiamtely one-third full (approximately 2 gram sample).
b. Carefully fill the pycnometer with boiled, distilled water. Place the pycnometer in a beaker within a vacuum desiccator. Evacuate until the water boils. Release the vacuum and again evacuate until bubbles appear, then seal the desiccator and leave the samples under vacuum for 5 minutes.
c. Remove the pycnometer from the desiccator. If necessary, add more boiled, distilled water and centrifuge the pycnometer for 5 to 10 minutes.
d. Insert the pycnometer plug such as to avoid the inclusion of air bubbles, then twist until the plug seats firmly but not so tight that it locks.
e. Place the pycnometer in a beaker filled with boiled, distilled water such that the pycnometer is submerged.
f. Place the beaker containing the pycnometer in a constant temperature bath maintained at 25° C.±0.1° C. Keep the beaker covered with a watch glass.
g. Leave the pycnometer in the bath at least 30 minutes. After 30 minutes, the pycnometer may be removed from the bath for weighing if the temperature has not changed for 10 minutes or if the fluctuation has been less than 0.1° C. (0.2° F.).
h. Remove the pycnometer from the bath and wipe the excess water from the top of the plug using one stroke of the hand or finger. Wipe the surface of the pycnometer with absorbent material with special attention given to the joint where the plug enters the pycnometer. Weigh the pycnometer immediately.

NOTE: If after removal of the pycnometer from the bath and wiping the plug, warming of the pycnometer causes the water to bead on the plug, do not remove the bead of water, but rather weigh the pycnometer as soon as possible.

i. Calculation:

$$\text{Tow Density (lb/in.}^3\text{) at } T^\circ\text{C.} = \frac{A \times E}{A + B - D} \times 0.0361$$

Where:

A = weight of sample, g.

B = weight of pycnometer plus water, g.

D = weight of pycnometer plus water plus sample, g.

T = temperature of bath. Unless otherwise stated, maintain bath at 25° C.±0.1° C.

E = density of water at temperature T° C. Unless otherwise stated, T° C. shall be 25° C. and the density (E) is 0.9971 g/ml.

5.2 Weight per unit length determination.

Determination of the weight per unit length of the tow shall be in accordance with the following:

a. Remove and discard a minimum of one complete layer of fiber from the spool. Then select a test length of fiber by pulling the tow off the spool in such a manner so as to prevent any side slippage of the tow as it is pulled off the spool. Smooth and collimate fiber specimen with gentle action of the fingers.

b. Cut tows into 48 inch (nominal) lengths. A minimum of 1 specimen is required.

c. Measure the actual length of each piece of tow to the nearest 1/32 inch.

d. Weigh each piece of tow to the nearest 0.1 milligrain.

e. Calculation: Weight per unit length (pounds/inch)

$$W_f = \frac{Wd(0.0022)}{B}$$

or for sized tow $$W_f = \frac{Ws(0.0022)}{B} \quad \frac{100 - \%\text{ size}}{100}$$

Where:

Wd = weight of each specimen of dry tow, g.

Ws = weight of each specimen of sized tow, g.

B = length of each specimen, inches.

% size = wt. percent size from 5.6 f. Record the weight per unit length of each tow specimen.

5.3 Determination of ultimate tensile strength and Young's Modulus of elasticity using Impregnated Strand Test.

The ultimate tensile strength and Young's modulus of elasticity of the tow shall be determined in accordance with the following:

5.3.1 Tow impregnation. Tow impregnation shall be in accordance with the following:

a. Prepare the impregnating resin solution I. as shown in Table I. Mix well. Do not heat.

SAFETY NOTE: Wear gloves when handling resins or any resin related product when exposed for greater than 5 minutes accumulative time in any hour period.

TABLE I

| Impregnating resin solution | |
|---|---|
| Ingredient | Parts by weight |
| Resin, ERL 2256 | 300 |
| Tonox 6040 | 88.5 ± 1.5 |
| Toluene | 66.6 ± 2.0 |

As alternatives to the above resin solution, the following can be used.

II. Mix 150, grams methylene chloride with 250 grams DER 332 resin to form component;

Mix 54.6 grams Tonox 60/40 with 345.4 grams methylene chloride to form component B; and Mix A and B for impregnating solution; or III. Mix 600 grams DER 330 with 246 grams methylene chloride to form component A;

Mix 18 grams $BF_3$MEA with 30 grams methyl ethyl ketone (MEK) to form component B; and Mix A and B for impregnating solution.

b. Transfer the resin solution into a pan as shown in FIG. 1. The resin solution shall be used within one hour after preparation.

c. Cut tow specimens to length (49.0±2.0 inches long). Attach a clamp (See FIG. 1) to one end. Coil the tow in the pan of resin solution to within 1.5±0.5 inches from the clamp. Raise the claim until the start of the impregnated section of the tow is next to the coil. (See FIG. 1) Wind that area of the tow into the coil.

NOTE: Choose a (orifice) wire coil size from which to obtain the proper resin content of 40 to 60 percent with carbon fiber. The wire coil orientation should be approximately vertical. To use the orifice correctly, draw the impregnated tow through the coil parallel to the cylinder formed by the wire coil.

d. Remove and collimate the resin-wet tow by pulling it slowly (approximately 1 foot/second) through the wire coil.

e. Hang impregnated tow horizontally on a specimen rack (See FIG. 5). Lay the clamp which has been attached to the tow (See FIG. 4) over the grooved roller (See FIG. 5(c)) and fix the loose or other end in the clamp, which is attached to the rack.

f. Examine strands for filament collimation in accordance with FIG. 6. Discard and remake all strands which are not acceptable.

g. Cure samples in a preheated oven at 350°±10° F. (177°±5° C.) for a minimum of one hour if resin I is used. If resin II is used, cure at 130° C. for 45 minutes followed by 175° C. for four hours. If resin II is used, cure at 85° C. for 45 minutes followed by 175° C. for four hours.

h. Repeat c. through g. for each tow specimen (5.2). Impregnate enough tows to satisfy 5.3.6-b. A maximum of two tows per spool should be sufficient.

5.3.2 Resin content determination. The resin content of the cured impregnated tows shall be determined in accordance with the following:

a. Cut each impregnated tow into three equal lengths (for 13 inch samples) or, four equal lengths (for 10 inch samples). Accurately measure lengths of each piece to the nearest 1/32 inch and weigh each piece to the nearest 0.1 mg. Calculate and record the weight per unit length of each impregnated tow in lb/in.

b. Calculation; Resin content (weight percent) =

$$\frac{Wi - Wf}{Wi \times 100} = \%R$$

Where:

Wi = weight per unit length of impregnated tow, lb/inch.

Wf = weight per unit length of dry tow (from 5.2), lb/inch.

c. Report the resin content of each 48 inch length of impregnated tow. Discard sample if resin content is less than 40 weight percent or greater than 60 weight percent.

5.3.3 Attachment of end-piece tabs. End-piece tabs shall be in accordance with the following:

a. Place the cut lengths (10" or 13") (5.3.2-a) of impregnated tows in the specimen mold (FIG. 7). This allows a span of 5.0±1/16" long between the end tabs. The end tab or grip piece will be about ¼"×⅜"×2.0", and molded on each end of the cut lengths.

NOTE: Mold cavities must be coated with a release agent such as Care #2 or equivalent.

b. Run Macromelt 6300 (or equivalent) Polyamide resin into the mold cavities from nitrogen blanketed reservoir (FIG. 9), containing molten resin maintained at 300°±5° C. (600°±20° F.).

5.3.4 Calibration of extensometer ana load. Calibrate the extensometer (10% maximum strain capability) and load as follows:

a. Set the extensometer on the special calibration fixture (FIG. 10). Adjust the micrometer to give a gap separation of exactly one inch. Adjust the strain recorder to give zero reading on the chart.
b. Open the extensometer 0.020 inches by rotating the micrometer. Adjust the strain recorder to register the proper chart travel depending on scale used. Use actual scale that will be used for testing samples (scale 500/1 is preferred). Do not let the extensometer swing or rotate on the fixture when turning the micrometer.
c. Repeat until zero, 0.005, 0.010, and 0.020 inch recordings register without adjusting.
d. Calibration of the extensometer should be done before testing begins, after a maximum of 48 specimens have been tested, or when Instron operators change.
e. Calibration of load shall be by dead weight at the beginning of testing. Use a 10 pound weight on a 20 pound full scale load. Load calibration must be done after 48 specimens have been tested or when operators change. Shunt calibration may be substituted for dead weight for subsequent calibrations.

5.3.5 Test procedure. The following should be used.

a. Mount the specimen in the pneumatic grips of the Instron tensile tester (FIG. 11). The end tabs should be aligned in the grips parallel to the side of the grips and perpendicular to the crosshead.
b. Apply light tension (up to 48 pounds) to the specimen gently by extending the crosshead.
c. Attach a one inch gage length strain gage extensometer (Instron catalog No. G-51-11) with 10 percent maximum strain capability to the impregnated tow (FIG. 10).
d. Use a 0.5 inch per minute crosshead speed.
e. Select a load scale 200 or 500 lbs. which best measures the type of fiber being tested.
f. Load the specimen to failure while simultaneously plotting the load versus elongation as shown in FIG. 12.
g. Discard all results from any specimen in which failure occurs in an inordinate manner, i.e., jaw breaks, slipped end tabs, sample breaks while removing extensometer, etc. A minimum of four good tests are required for calculations.

NOTE: Jaw breaks are defined as a single break at one tab end with the full length of the impregnated tow strained remaining intact on the opposite tab.

5.3.6 Ultimate tensile strength. The ultimate tensile strength of the tow shall be calculated as follows:

a. Calculation:

Tow tensile strength (uncorrected for resin load) (psi) =

$$S_T = \frac{P_{max}}{(Wf/pf)} = \frac{P_{max}}{Af}$$

Where:

$P_{max}$=ultimate breaking load of impregnated tow, pounds/inch

Af=cross sectional area of tow (WF/pf), square inch

Wf=weight/unit length dry tow (5.2), pounds/inch pf=density of tow (5.1), pounds/cubic inch NOTE: Calculations may be corrected to account for the load carried by the resin as described in the addendum.

b. Report the median of a minimum of four determinations.

5.3.7 Young's modulus of elasticity. The Young's modulus of elasticity of the tow shall be determined in accordance with the following:

a. Using the load elongation chart produced by the Instron Tensile Tester (5.3.5) determine the following parameters:

L=incremental strain determined by inspection, inches.

P=load increment at the selected incremental strain, pounds b. Calculation:

Young's modulus of elasticity (uncorrected for resin load) (psi) =

$$E_T = \frac{P}{Af} \times \frac{L}{L}$$

Where:

Af=cross sectional area of tow (5.3.6) square inches.

L=gage length over which strain is measured (1 inch)

c. By arranging L to be 0.01 inch by setting the chart magnification ration to 500/1 and taking P at a chart distance of five inches, the calculation can be simplified to:

$$E_T = \frac{P}{Af} \times \frac{1}{0.01} = \frac{P}{Af} \times 100$$

The value of P can be determined by drawing a modulus slope from the load-elongation curve by extending a line tangent to the linear portion of the curve at a point approximately one-half the obtained breaking load (See FIG. 12).

NOTE: Calculations may be corrected to account for the load carried by the resin as described in the addendum.

d. Report the average of a minimum of four determinations.

5.4 Ionic impurities determination (conductivity).

Ionic impurities of surface treated carbon or graphite fibers are determined by measuring the conductivity of water extracts in accordance with the following:

5.4.1 Preparation of conductivity water.

a. Run distilled water through a demineralizer.
b. Determine the conductance of the water at 20°±0.5° C. Continue to take the readings until a constant reading is obtained.
c. The conductance is measured by dipping the cell in the solution and balancing the meter. Make sure no bubbles adhere to the electrodes.

d. The conductance of the water should be less than 10 umho/cm.

5.4.2 Calibration of cell constant.

a. Condition of KCl standard to 20°±5° C.
b. Determine the conductance as described in 5.4.1.
c. Calculate the cell constant as follows:

$$K = \frac{\text{cell constant for 0.1N KCl std.}}{\text{Observed Reading}}$$

5.4.3 Conductance of water samples.

a. Condition the water to 20° C.±0.5° C.
b. Measure the conductance as described in 5.4.1.
c. Calculate as follows:

Conductance (umho/cm)=K×observed reading 5.4.4 Graphite or carbon fiber samples.

a. Weigh 10 grams of sample into a 500 ml extraction flask.

NOTE: If sufficient fiber is not available for a 10 gram sample, use a ratio of 10 grams/200 ml of water.

b. Add 200 ml of conductivity water.
c. Connect to a reflux condenser and bring rapidly to a boil.
d. Disconnect and remove the flask while the solution is still boiling. Close immediately with a glass stopper preferably fitted with a stopcock.
f. Cool rapidly to 20°±0.5° C. Filter sample through sharkskin filter paper.
g. Transfer some of the extract to a beaker and determine the conductance of the solution as in 5.4.1. Calculate the conductance as in 5.4.3.
h. Run a blank solution along with the fiber samples and subtract the blank conductance from the sample conductance.
i. Report the conductance of the sample extract and the temperature of determination.

5.4.5 pH of extract. If requested, use the remaining sample extract not used for conductivity to determine the pH with a pH meter. Report the pH for each conductivity test.

5.5 Sizing content. The sizing content of the fiber shall be determined as follows:

a. Weigh 2 to 3 grams (f) of fiber to nearest 0.1 milligram (mg).
b. Place specimen in 250-milliliter (ml) Erlenmeyer flask, and add 100 to 125 ml of methylene chloride.
c. Place rubber stopper on flask, and shake flask gently for approximately 1 minute.
d. Decant methylene chloride, being careful not to lose any fiber.
e. Repeat steps b, c, and d two additional times.
f. Remove specimen from flask.
g. Place specimen in oven for minimum of 5 minutes at 177±5 degrees Celsius (°C.).
h. Remove specimen from oven, cool to room temperature, and weigh to nearest 0.1 mg.
i. Calculate sizing content as follows:

$$\text{Percent sizing} = \frac{W_1 - W_2}{W_1}(100)$$

Where:

$W_1$=original weight of sample, g.

$W_2$=weight of sample after removal of sizing, g.

ADDENDUM TO TOW TEST

Correction of Calculations

SCOPE.

The tensile strength and elastic modulus calculations (5.3.6 and 5.3.7) assume that all of the load on the test specimen is carried by the carbon or graphite fiber. While the values calculated using this assumption closely approximate the properties of the tow, an even closer approximation may be made by correcting the breaking load and the incremental load used in the elastic modulus calculation to account for the load carried by the resin. Typical correction methods are as follows:

A.1 Tensile strength correction. Fiber tensile strength corrections for resin contribution are complicated by the fact that the impregnating resin does not show a constant stress/strain relationship as does the fiber. There is no "typical" modulus for the resin because the stress/strain relationship is curved rather than linear. The curvature of the stress/strain curve also varies from lot to lot, can to can, and even mix to mix. Ideally, then one should know the stress/strain curve for the particular mix used to impregnate the test specimens, but this is not economically feasible. What has been determined to be reasonable practice is to use the average secant modulus of the resin at the average breaking strain for the particular fiber being tested. The tensile strength correction is, therefore, calculated as follows:

a. Average secant modulus values ($E_r$) for ERL 2256/Tonox are as shown in Table II.

TABLE II

| Secant Modulus for ERL 2256/Tonox | |
|---|---|
| Fiber | $E_r$, $10^3$ psi |
| Type A | 458 |

b. Calculate average cross-sectional area of resin ($A_r$) in the impregnated tow:

$$A_r = \frac{(W_1 - W_f)}{pr}$$

Where:

$W_i$=weight per unit length of impregnated fiber, lbs/inch $W_f$=weight per unit length of dry fiber, lbs/inch $p_r$=resin density (0.0455 for ERL 2256/Tonox), lbs/inch$^3$ lbs/inch$^3$ c. Calculate the load carried by the resin (Pr) at breakage:

$$Pr = \frac{P_{max}(0.01\ E_r)\ (A_r)}{Py}$$

Where:

$P_{max}$=breaking load, lbs.

Py=total specimen load at 1% strain, lbs.

$E_r$=resin secant modulus (Table II), psi d. Calculate the corrected tensile strength, ($S_c$) of the fiber:

$$S_c = \frac{(P_{max} - P_r)}{A_f}$$

Where:

$A_f$=cross-sectional area of fiber (5.3.6), square inch.

A.2 Modulus of elasticity correction. The modulus of elasticity correction for the resin contribution is also calculated using the average secant modulus of the resin at the average strain for the particular fiber being tested as discussed in A.1. The calculation is made as follows:

a. Calculate the resin load at 1% strain ($P_{r1}$):

$$P_{r1} = (0.01\ E_r)\ (A_r)$$

b. Calculate the corrected modulus of elasticity ($E_e$) of the fiber as follows:

$$E_e = \frac{(P_y - P_{r1})}{A_f/0.01}$$

APPENDIX II

Test Methods for Determining Properties of Carbon Fiber Tows Using the Laminate Test

1. SCOPE

Methods for determining the density, length per unit weight, ultimate tensile strength (Laminate Test), percent elongation at failure, Young's modulus of elasticity (Laminate Test), twist and size content of graphite tows and short beam shear strength (Laminate Test).

2. DEFINITIONS 2.1 Lot.

A lot shall consist of carbon fiber produced from one continuous production operation under one set of operating conditions. This lot may be produced with interruptions in processing of up to 72 hours assuming all fiber is produced under the same process conditions and is processed at steady state conditions.

2.2 Sampling.

Randomly select a minimum of six spools of fiber from each doff or two spools for every 8-hour production shift for testing to yield lot averages for fiber density, weight per unit length, sizing level, and workmanship. Randomly select one sample per lot for twist testing. Enough samples will be selected from the first and last doffs to allow a set of laminates to be made. If the fiber run exceeds six days, laminate tests shall be performed on a midrun doff.

3. PROVISIONS 3.1 Equipment Calibration

Testing instrumentation and equipment shall be calibrated in accordance with applicable suppliers operating instructions or manuals and requirements of the test facility.

3.2 Drawings

Figure 13:
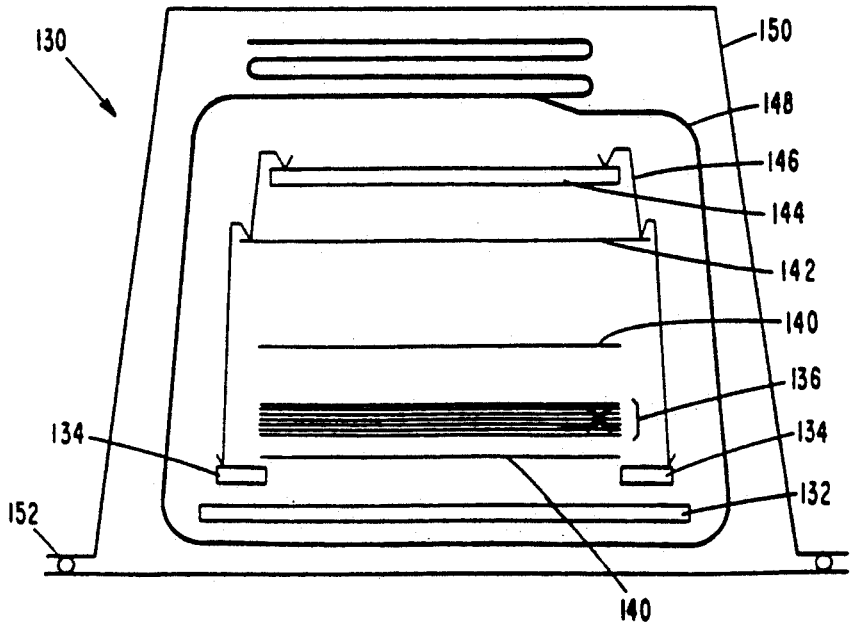

FIGS. 13–18 illustrate procedures and equipment used in the Laminate Test for determining Tensile Strength, Modulus and Short Beam Shear Strength. In FIG. 13 is shown lay up device 130 for laying up specimens for the Tensile and Modulus tests. In FIG. 13 is depicted aluminum base plate 132 which has a thin uniform coat of Frekote 33 release agent, cork dam 134 which has a pressure sensitive Corprene adhesive backing, prepreg panel 136 with thermocouple 138, peel plies (top and bottom) 140, Teflon release film 142, Caul plate 144, pressure sensitive green polyester silicone tape 146, air bleeder 148 of four plies of Style 1581 fiberglass, vacuum bag 150 of Film Capron 80, nylon (0.002 inches thick and high) temperature sealant 152. For tensile specimens the prepreg lay up is nominally 0.040 inches thick while shear specimens are nominally 0.080 inches thick. Further, the release fabric 140 is Engab TX 10-40 release (porous) fabric in making the shear specimens.

Figure 14:
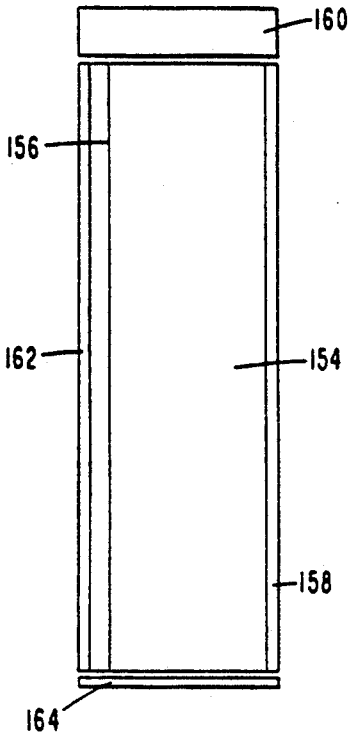

FIG. 14 schematically depicts trimming of the Tensile Panel 154 where 156 is the Kevlar tracer yarn. During trimming, borders 158, 160, 162 and 164 are removed from around specimen 154 where 158, 162, and 164 are ¼ inch wide and 160 is ¾ inches wide.

Figure 15A:
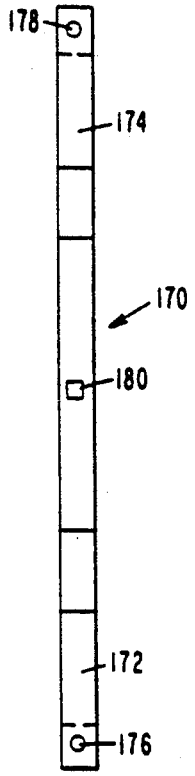
Figure 15B:
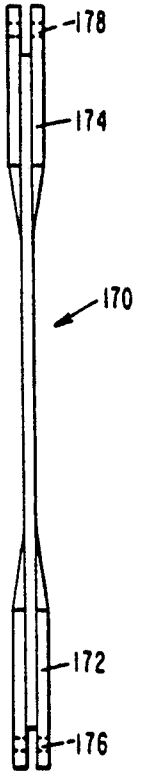

FIGS. 15 (A) and (B) illustrate tensile specimen 170 having end tabs 172, 174 adhered to each end. End tabs 172, 174 have orifices 176, 178 and extend beyond the ends of tensile specimen 170. Tensile specimen 170 is of 0.040 nominal thickness, 9 inches long (0° fiber direction) and 0.50 inches wide. Tensile specimen 170 is shown in FIG. 15 (A) with strain gauge 180.

Figure 16:
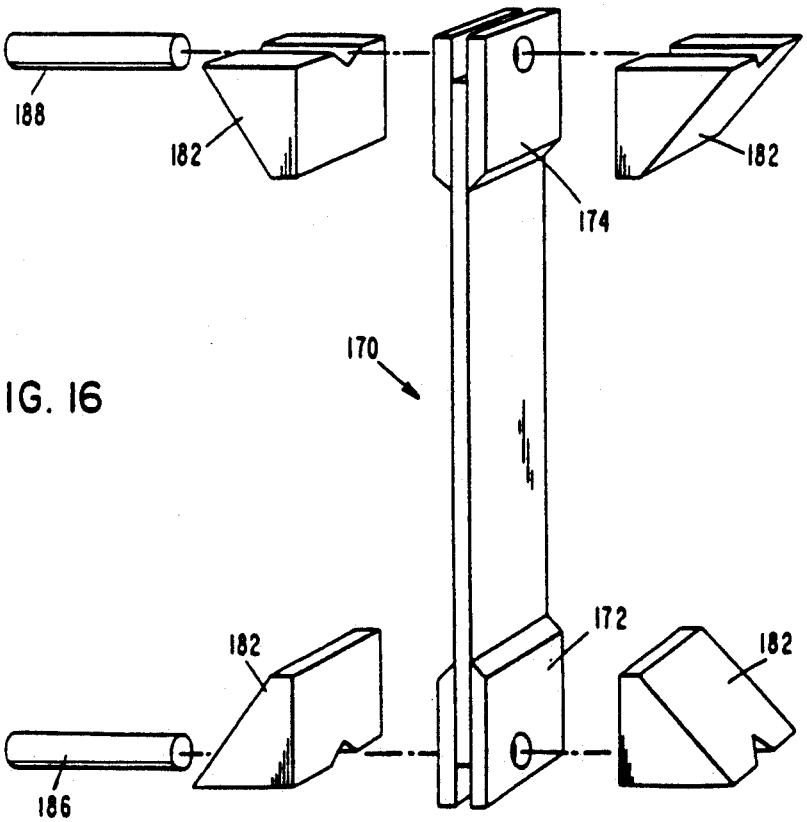
Figure 16A:
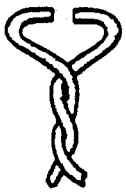

FIG. 16 shows schematically the 0° test arrangement in which modified Instron grips 182, 184 along with rods 186, 188 are shown aligned with their positions on end tabs 172, 174 during testing. FIG. 16A illustrates the shape of the wire of 5.5.4.1.9(b).

Figure 17:
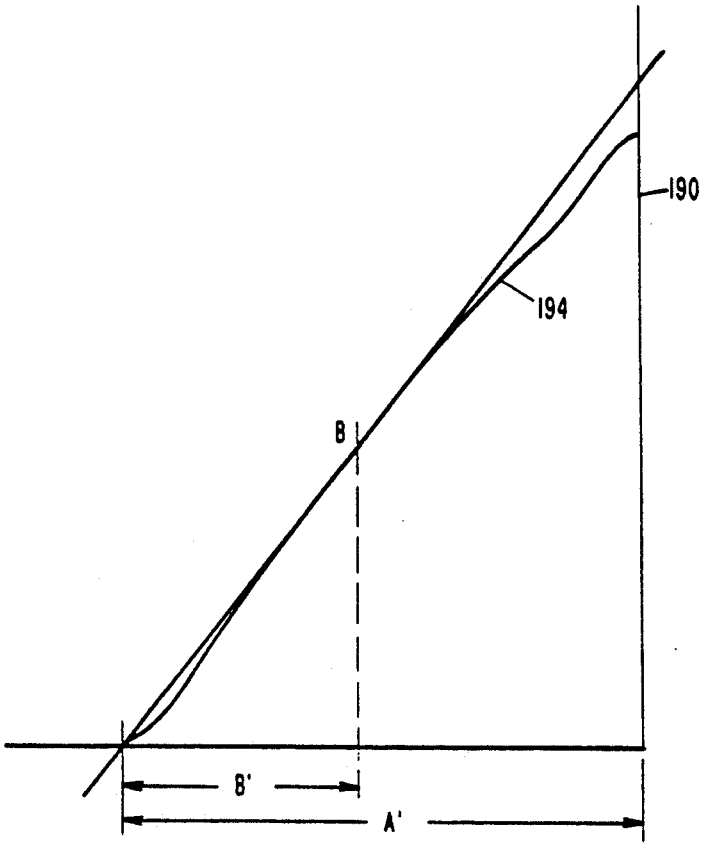

FIG. 17 shows a stress strain curve wherein 190 is the maximum load, 192 is one-half the maximum load, 194 the empirical stress strain curve and 194 is the line drawn tangent to the curve 194 at one-half maximum load. The slope of curve 194 is the tensile modulus of the Laminate Test.

Figure 18A:
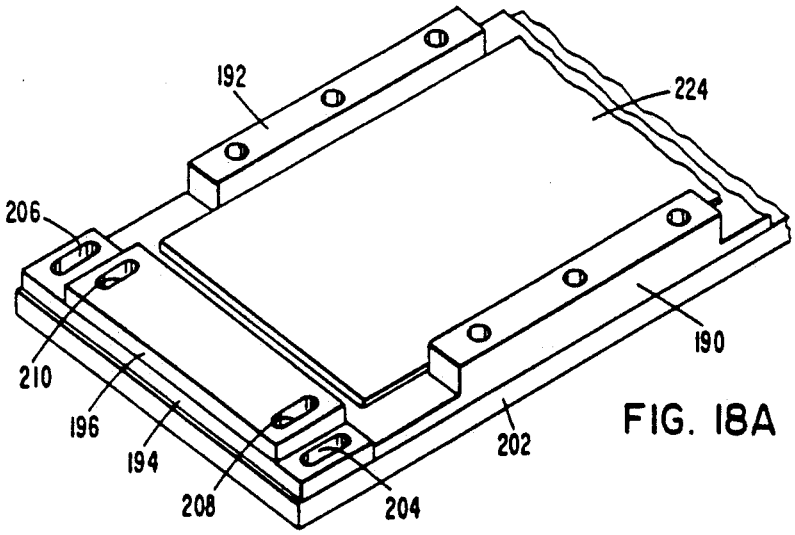
Figure 18B:
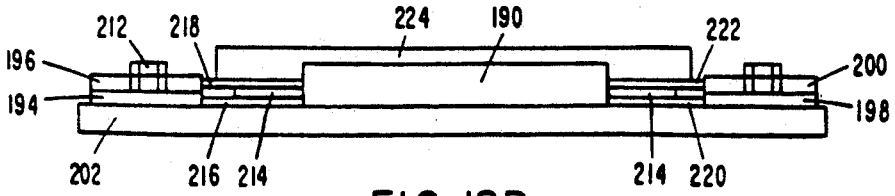

FIGS. 18 (A) and (B) depict the tabbing mold assembly having side rails 190, 192, adjustable end rails 194, 196 and 198, 200 and base plate 202. Adjustable end rail 194 has slots 204, 206 and adjustable end rail 196 has slots 208, 210. Bolts such as bolt 212 fits in each of slots 204, 206, 208 and 210 to allow end rails 194, 196, 198, 200 to slip fore and aft in aligning the test specimen. The test specimen, see in FIG. 18 (B) as 214 has tabs 216, 218, 220 and 222 which are under caul plate 224.

| | Description |
|---|---|
| Materials | |
| 3501-5A Resin | Hercules, Epoxy Resin (HS-SG-575) |
| MY-270 | Ciba-Geigy, tetraglycidyl methylene dianiline |
| DDS | Ciba-Geigy bis (para amino phenyl) sulfone |
| $BF_3$MEA | Harshaw Chemical Boron Trifluoride monoethanolamine |
| Dichloromethane | ($MeCl_2$) MIL-D-6998 |
| Scotchbrite | 3M Company |
| Tracer yarn | 190 Denier Kevlar Roving |
| Plastic sheet | ⅛" thick |
| Chlorobenzene | ACS Reagent Grade |
| High temperature sealant | Schnee Morhead |
| Release film | Teflon, nonperforated, 0.001 to 0.004 inch thick |
| Cork dam | Cork ⅛" by 1" with pressure sensitive adhesive backing (Corprene) (or equivalent). |
| Tape | Pressure sensitive, green polyester silicone 1" and 2" |
| Air bleeder | Style 1581 Fiberglass or equivalent |
| Vacuum bag | Film, Capran 80 High Temp. nylon 0.002 inch |
| Masking tape | 2" wide and 1" wide |
| Sand paper | 100 and 320 grit |
| Adhesive | American Cyanamid, FM-123-2 .05#/ft$^2$ |
| Fiberglass tabbing | 7 ply, 0.065", Scotchply |

-continued

| | Description |
|---|---|
| plates | 1002 |
| Adhesive | Eastman 910, Eastman Chemical Products (HS-CP-150) |
| Strain gages | SR-4, FAE-12S-12S13, BLH Electronics, Inc. |
| Solder | 0.020 Energized resin core F, Alpha Metals Inc. |
| Peel ply | Release fabric ply B, Airtech |
| MEK | ACS reagent grade |
| Nitrogen | Compressed, 180 psi min. |
| Wire | 1101 3/C #32 7/40 DVE cond. twisted, Alpha Wire Corp. |
| Filter paper | Whatman No. 41 |
| Alcohol | ACS Reagent Grade |
| Ether | ACS Reagent Grade |
| Acetone | ACS Reagent Grade |
| Gage Kote | #'s 1, 2, 3, and 4 kit, Wm. T. Beam Co. |
| Emery Cloth | No. 220 Grit |
| Transparent tape | Scotch type - ½" |
| Teflon tape | ½" |
| $H_2O$ | Distilled |
| Equipment | |
| Grit Blaster | Iron-Constantan No. 30 or equivalent |
| Thermocouple | |
| Thermocouple readout | Any standard millivolt recorder |
| Platen press | Wabash hydraulic press, Model 20-12 2TMB, 800° F. maximum temperature or equivalent |
| Saw | Micromatic - precision wafering or equivalent |
| Ohmmeter | Fluke Model #810 or equivalent |
| Soldering iron | Small tip 115 volt, 25 watt or equivalent |
| Base plate | Aluminum, ¼ to ½" thick |
| Caul plate | Aluminum, .080" thick |
| Knives | X-acto type and single edge razor blade |
| Beakers | 250 ml |
| Flask | 250 ml Erlenmeyer |
| Pycnometer | Hubbard type, or equivalent |
| Pycnometer | Side arm, 50 ml |
| Forced air oven | Blue M Power-P-Matic 60 (Blue M Electric Co.) Blue Island, Illinois, or equivalent. |
| Oven | Vacuum, capable, 85° C. |
| Balance | Analytical balance, Mettler B-5, or equivalent |
| Vacuum desiccator | Pyrex, A. H. Thomas catalog no. 4443, or equivalent |
| Vacuum source | Water aspirator or air pump, A. H. Thomas catalog no. 1038-B, or equivalent |
| Centrifuge | International Clinic Centrifuge Model CL, or equivalent |
| Constant temperature bath | Capable of maintaining 25° ± 0.1° C. (77° ± 0.2° F.) |
| Thermometer | Graduated in 0.1° C. subdivisions |
| Tensile tester | Instron, floor model, or equivalent |
| Wire coil | 1" long, 18 gage copper wire, ¼" inside diameter |
| Suspending wire | Stainless 300 series, .008" diameter |
| Platform | Aluminum, 4½" × 4" approximately two 1" ends bent 90° |
| Autoclave | Capable of a programmed heat rate ±2° F. to 400° F., minimum vacuum holding of 23" Hg in part with simultaneous autoclave pressure of 100 +10, −0 psi. Capable of maintaining 400° ± 5° F. |
| Vacuum tube | Minimum of 8" × ¼" copper tube with ¼" tube fitting on one end. Air bleed wrapped around the last 2½" of end of tube. |
| Ballpoint micrometer | IKL .0001 display, model #1-645-2P, or equivalent |
| Fixture | Drilling, 3/16 bushing |
| Fixture | Tabbing, 6" wide |

5. TEST PROCEDURES.

5.1 Weight per Unit Length Determination.

Determination of the weight per unit length of the tow shall be in accordance with the following:

a. Select a test length of fiber by pulling the tow off the spool in such a manner so as to prevent any side slippage of the tow as it is pulled off the spool. Smooth and collimate fiber specimen with gentle action of the fingers.

b. Cut tows into 48" (nominal) lengths. A minimum of one (1) specimen is required per spool.

c. Measure the actual length of each piece of tow to the nearest 1/32".

d. Weigh each piece of tow to the nearest 0.1 milligram.

e. Calculation: Weight per unit length (yds./lb.)

$$L_f = \frac{B(12.6)}{W_d}$$

or for sized tow:

$$L_f = \frac{B(12.6)}{W_s} \times \frac{100}{100\%\ \text{size}}$$

Where:

$W_d$=weight of each specimen of unsized tow, g.

$W_s$=weight of each specimen of sized tow, g.

B=length of each specimen, inches

% size=weight percent size from 5.2.

To convert length/wt. yds./lb. weight/length lbs./inch:

$L_w = 0.0278/L_f$ f. Record the required value of each tow specimen.

5.2 Sizing Content.

The sizing content of the fiber shall be determined as follows:

a. Weigh 2 to 3 grams (g) of fiber to nearest 0.1 milligrams (mg).

b. Place specimen in 250 milliliter (ml) Erlenmeyer flask, and add 100 to 125 ml of methylene chloride.

c. Place rubber stopper on flask, and shake flask gently for approximately 3 minutes.

d. Decant methylene chloride, being careful not to lose any fiber.

e. Repeat steps b, c, and d, two additional times.

f. Remove specimen from flask.

g. Place specimen in oven for minimum of 15 minutes at 177±5 degrees Celsius (°C.).

h. Remove specimen from oven, cool to room temperature, and weigh to nearest 0.1 mg.

i. Calculate sizing content as follows:

$$\text{Percent sizing} = \frac{W_1 - W_2}{W_1} \times (100)$$

Where:

$W_1$=original weight of sample, g.

$W_2$=weight of sample after removal of sizing, g.

5.3 Determination of Tow Density. (Shall be determined by Method A or B).

5.3.1 Method A, density by immersion of chlorobenzene.

a. Determine the density of the chlorobenzene with a side arm pcynometer. Record density. Rerun density about once a week or when the density of the chlorobenzene is; suspected to have changed.

b. Weigh saddle in air. Record weight.

c. Weigh the saddle immersed in chlorobenzene. Record weight.
d. Roll masking tape around end of a fiber tow. Do the same to the other end of the tow sample. A tow sample four to five inches is desirable.
e. If the sample has been exposed to unusually high humidity or contains; more than 2 percent moisture, place the sample in a 85° C. vacuum oven and pull a vacuum for one hour.
f. Remove sample from oven and thread the tow through the inside diameter of the saddle. Cut tow at both ends with a razor blade so that the center bore of the saddle contains the sample.
g. Weigh saddle and sample in air. The sample, itself, should weigh between 0.2 to 0.3 g. Record weight.

NOTE: ASSURE THAT DURING THE PRIOR TWO STEPS, THE FIBER DOES NOT PICK UP AN APPRECIABLE AMOUNT OF WATER, I.E., MORE THAN TWO PERCENT. THIS IS BEST ACCOMPLISHED BY MAINTAINING ROOM RELATIVE HUMIDITY LOW AND PERFORMING THESE TWO STEPS RAPIDLY. AS AN ALTERNATIVE, PLACE SAMPLES IN SADDLE AND THEN DRY BOTH TOGETHER AT 85° C. UNDER VACUUM FOR ONE HOUR. COOL IN A DESICCATOR AND PROCEED.

h. Place the saddle and sample in a 250 ml beaker containing chlorobenzene.
i. Place the beaker, saddle, and sample in a vacuum desiccator. Pull vacuum until no air is entrapped in the sample. It is essential that all air be removed from the sample.
j. Remove beaker, saddle, and sample, and place in a constant temperature bath for 20 minutes or until the chlorobenzene is 23° C.±0.1° C. Check chlorobenzene with a thermometer.
k. Remove from bath and suspend sample from balance beam while chlorobenzene rests on Al platform. Record weight.
1. Calculation:

$$p = \frac{(B - C)A}{(B - C) - (D - E)}$$

Where:
A=density of chlorobenzene, g/cc.
B=weight of sample and saddle in air, g.
C=weight of saddle in air, g.
D=weight of sample and saddle in chlorobenzene, g.
E=weight of saddle in chlorobenzene, g.
P=density of fiber, g/cc.

NOTE: FILTER CHLOROBENZENE OCCASIONALLY THROUGH WHATMAN NO. 41 FILTER PAPER TO REMOVE LOOSE FIBERS. WEIGHTS SHOULD BE TAKEN TO THE NEAREST 0.1 mg. SIZING MUST BE REMOVED FROM TOW PRIOR TO DENSITY MEASUREMENT.

5.3.2 Method B, density by water pycnometer.

5.3.2.1 Calibration of pycnometer. The pycnometer shall be calibrated as follows:

a. Clean the pycnometer thoroughly using sodium dichromate cleaning solution.
b. Dry the interior by rinsing it successively with tap water, distilled water, and either alcohol and ether or acetone.
c. Expel the solvent vapors with a current of air which has been passed through absorbent cotton and Drierite. Do not subject pycnometer to any considerable elevation of temperature.
d. Prior to weighing, wipe the entire pycnometer first with a piece of clean moist cloth and then with a dry cloth. Weigh the empty pycnometer immediately.
e. Carefully fill the pycnometer with freshly boiled distilled water which is slightly below the temperature of the bath.
f. Insert the pycnometer plug with a rotary motion to avoid the inclusion of air bubbles and then twist until it seats firmly but not so tight that it locks.
g. Place the pycnometer in a constant temperature bath maintained at 25.0°±0.1° C. Leave the pycnometer in the bath at least 30 minutes.
h. Check the bath to be certain the temperature has not changed. Then remove the pycnometer from the bath and wipe the excess water from the top of the plug using one stroke of the hand or finger.
i. Wipe the surface of the pycnometer with absorbent material giving special attention to the joint where the plug enters the pycnometer.
j. At this point, examine the pycnometer to be certain that it is entirely filled with water. (If any air bubbles are present, fill the pycnometer again and replace it in the bath.)
k. Remove the pycnometer from the bath and wipe the entire surface with a piece of clean moist cloth and then with a dry cloth. Special attention should be given to the area around the joint where the plug enters the pycnometer. Weigh the pycnometer immediately.

5.3.2.2 Density determination. The density of the tow shall be determined as follows:

NOTE: SIZING MUST BE REMOVED FROM SIZED TOW PRIOR TO THE DENSITY DETERMINATION.

a. Accurately weigh enough of the sample into the pycnometer to fill the pycnometer approximately one-third full (approximately 2 gram sample).
b. Carefully fill the pycnometer with boiled, distilled water. Place the pycnometer in a beaker within a vacuum dessicator. Evacuate until the water boils. Release the vacuum and again evacuate until bubbles appear, then seal the desiccator and leave the samples under vacuum for 5 minutes.
c. Remove the pycnometer from the desiccator. If necessary, add more boiled, distilled water and centrifuge the pycnometer for 5 to 10 minutes.
d. Insert the pycnometer plug such as to avoid the inclusion of air bubbles, then twist until the plug seats firmly but not so tight that it locks.
e. Place the pycnometer in a beaker filled with boiled, distilled water such that the pycnometer is submerged.
f. Place the beaker containing the pycnometer in a constant temperature bath maintained at 25.0° C.±0.1° C. Keep the beaker covered with a watch glass.
g. Leave the pycnometer in the bath at least 30 minutes. After 30 minutes, the pycnometer may be removed from the bath for weighing if the temperature has not changed for 10 minutes or if the fluctuation has been less than 0.1° C. (0.1° F.).
h. Remove the pycnometer from the bath and wipe the excess water from the top of the top of the plug using one stroke of the hand or finger. Wipe the surface of the pycnometer with absorbent material with special attention given to the joint where the plug enters the pycnometer. Weigh the pycnometer immediately.
i. Calculation:

$$\text{Tow density (lb/in.}^3\text{) at } T^\circ\text{C.} = \frac{A \times E}{A + B - D} \times 0.0361$$

Where:
A=weight of sample, g.
B=weight of pycnometer plus water, g.

D=weight of pycnometer plus water plus sample, g.
T=temperature of bath. Unless otherwise stated, maintain bath at 25° C.±0.1° C.
E=density of water at temperature T° C. Unless otherwise stated, T° C. shall be 25° C. and the density (E) is 0.9971 g/ml.

5.4 Twist Test.

This test is used to determine the number of twists per inch of the carbon fiber tow.

a. Remove any frayed surface fiber from the package to be tested.
b. Attach free end of carbon fiber spool to the fixed clamp on the top of the "U" frame. While holding the fiber package horizontal.
c. Unspool the fiber from the package while keeping the package horizontal. (Do not twist the package while unspooling.) Rest package on the base of the "U" frame.
d. Attach the free clamp directly under the 36" wire. (Do not cut sample free from package.)
e. Insert a fine, pointed, polished stylus into the center of the sample at the top fixed clamp.
f. Draw the stylus down the sample, splitting the tow to the 36" wire. (Watch for rotation of the movable clamp.)
g. Hold stylus at the 36" wire, cut fiber from spool below the movable clamp. Count the number of rotations of the movable clamp.
h. Twist/in=number of rotations of movable clamp/36. Report to 2 significant digits. Example=1.5 rotations/36 in.=0.04 tpi.

5.5 Tensile Strength, Modulus, and Short Beam Shear Determination.

5.5.1 Prepreg. Samples selected from the lot shall be converted to prepreg using 3501-5A resin. Prepreg fiber areal weight shall be 0.0315±0.00084 lbs/ft$^2$. Prepreg resin content shall be 35±3%. Prepreg will include a Kevlar tracer yarn located 0.25±0.10" from either edge. In lieu of 3501-5A, combine 100 parts by weight MY-720, 36.75 parts by weight DDS and 0.5 parts by weight $BF_3$MEA such that the epoxy to diamine functionality ratio is 1:0.75.

SAFETY NOTE: WEAR GLOVES WHEN HANDLING RESIN, PREPREG OR ANY RESIN RELATED PRODUCT WHEN EXPOSED FOR GREATER THAN 5 MINUTES ACCUMULATED TIME PER 8 HOURS.

5.5.2 Prepreg Test Procedure.

5.5.2.1 Prepreg resin content, areal weight, and laminate fiber volume. The fiber volume of the laminate shall be determined as follows:

a. Cut 12.000±0.030 inches of 3" tape.
b. Weigh cut tape to nearest 0.0001 grams ($W_1$)
c. Place prepreg and 100 ml methylene chloride in 250 ml Erlemeyer flask.
d. Place stopper in flask.
e. Place flask on shaker and shake 1 minute minimum.
f. Decant solvent off.
g. Repeat steps c through f two additional times.
h. Dry in oven at 177°±10° C. for 15 minutes.
i. Remove from oven and allow sample to cool.
j. Reweigh sample to nearest 0.0001 gram ($W_2$).
k. Calculate as follows:

$$\text{Resin content, (\%)} = \frac{W_1 - W_2}{W_1} \times 100$$

-continued $$\text{Prepreg areal weight (lb/ft}^2\text{)}\ A_w = W_2 \times 0.0088$$

$$\text{Fiber thickness/ply (inches)}\ T_f = \frac{A_w}{144 \times pf}$$

$$\text{Fiber volume, (\%)}\ F_v = \frac{T_f}{T_p} \times 100$$

Where:
$W_1$=weight of 36 in.$^2$ of prepreg, g.
$T_f$=fiber thickness/ply, (inches)
$T_p$=cured ply thickness of prepreg measured from panel (inches)
$W_2$=dry fiber weight from prepreg, g.
$F_v$=fiber volume (%)
$A_w$=prepreg areal weight, (lb/ft$^2$)
pf=fiber density, (lb/in.$^3$)

5.5.3 Test panel preparation FM 123-2. Test specimens shall be prepared for testing per the following requirements.

a. The panel tensile and shear shall be layed up for cure as shown in FIG. 13, as described.
b. The cure cycle is as follows:
   1) Place vacuum bagged layup in autoclave and close autoclave.
   2) Apply minimum vacuum of 23 inches Hg.
   3) At a rate of 3° to 5° F. per minute, raise the laminate temperature to 350°±5° F. During the heat up, apply 85+10, −0 psi when the laminate temperature reaches 275°±5° F.
   4) Hold at 23 inches Hg (minimum), 85 +10, −0 psi, and 350°±5° F. for 60 +5 minutes.
   5) At a rate of 13°±2° F. per minute, lower laminate temperature to 150°±5° F.
   6) Release autoclave vacuum and pressure.
   7) Remove layup from autoclave.
   8) Remove panel from vacuum bag.

5.5.4 Mechanical Test Procedures 5.5.4.1 Tensile strength and modulus test. The tensile strength and tensile modulus of elasticity of laminates shall be determined in accordance with the following:

5.5.4.1.1 Tensile panel tabbing. End tabs shall be applied to tensile panels as follows:

5.5.4.1.2 Preparing the panel.

a. Trim ¼" off one end of 10" panel length.
b. Cut other end of panel to a length of 9.0±0.1"
c. True up edges of panel, so panel will fit into tab mold. Make sure there are no high edges that will interfere with the seating of the end tabs.
d. Remove peel ply from both sides approximately 2¼" back from each end, Leave peel ply attached in center .

NOTE: IF TWO 3×10 PANELS ARE BEING BONDED AT THE SAME TIME, TAPE PANELS TOGETHER BY PLACING A STRIP OF 1" GREEN TAPE LENGTHWISE (BOTH SIDES) ON CENTER PEEL PLY SURFACE ONLY.

e. Determine the mid-point between ends, then measure out 2.75 inches each way and draw parallel lines that are transverse to 9" dimension. This will allow equal spacing on the ends and maintain the 5.5 inch spacing of the end tabs.
f. Wash panel ends by flooding with MEK solvent applied from a squeeze bottle.
g. Allow the panel to air dry while preparing end tabs for bonding.

5.5.4.1.3 Preparation of tabs for room temperature tests using FM-123-2.

a. Remove FM-123-2 adhesive from freezer and allow to warm to room temperature.
b. Cut fiberglass tab plates so that width is 4 inches for a 3 inch panel and 7 inches for a 6 inch panel.
c. Grit blast the flat tab surface uniformly until no gloss remains.
d. Degrease thoroughly by scrubbing with MEK wet cloths until a clean cloth no longer shows a residue. Then rinse surface by flooding with MEK. Air dry 15 minutes minimum before using.
e. Then place prepared surface down on a sheet of FM-123-2. Press down firmly with thumb to make good contact between tab and resin. Trim closely around tab with a sharp knife. Care should be taken not to contaminate the resin during handling.
f. Place bottom tabs into position in fixture, aligning beveled edges with ends of the side bars. Hold in position by positioning the bottom mold end plate snugly along the backside of the tab and tighten outside screws.
g. Remove release paper from bottom tabs then position the panel over the tabs aligning the index marks with the ends of the side bars. Press panel firmly onto tab adhesive.
h. Remove release paper from top tabs and place top tabs into position over panel, aligning beveled edge with ends of the side bars. Adjust top end plates snugly along the ends of the top tabs and tighten inside screws.
i. Assemble tabbing fixture pressure plate over tabs.

5.5.4.1.4 Press cure cycle.

a. Place mold assembly into press preheated to 250° F.
b. Apply pressure of 40 to 50 pounds per square inch calculated for actual bond area. Maintain this pressure throughout cure cycle.

CAUTION: THIS IS NOT GAGE PRESSURE. VALUE FOR GAGE PRESSURE MUST BE CALCULATED FOR EACH PRESS.

c. Cure for 1 hour.
d. Cool press platens while maintaining pressure to a temperature below 150° F.
e. Remove pressure and remove mold assembly.
f. Cut the test specimens to the configuration shown in FIG. 15.

5.5.4.1.4.1 Test specimen preparation. The specimen shall be cut from laminate panels in accordance with the following:

a. Set up the panel cutting machine to accept the diamond cutting wheel.

NOTE: MACHINE SET UP SHOULD BE DONE ONLY BY QUALIFIED PERSONS. THIS MAY OR MAY NOT BE THE OPERATOR WHO CUTS THE PANELS.

b. Clean indexing table surface until free of dirt and water.
c. Take a piece of ⅛" thick plastic sheet, larger than the panel to be cut, and fasten to the indexing table with double-faced masking tape.
d. Adjust the cutting wheel to make a 1/32 to 1/16 inch cut in the plastic sheet.
e. Apply double-faced masking tape on one side of the laminate panel to be cut (tape in tab area).
f. Place the panel on a cut-free surface of the plastic sheet on the indexing table, aligning the panel with tracer yarn to ensure that machine cuts will be 90°, 0°±0.250° to the unidirectional orientation of the fiber.
g. Trim ⅛ inch from each side.
h. Index table to provide proper width of specimen and cut. Be sure to allow for the width of the diamond cutting wheel in indexing for all cuts.
i. Repeat process to obtain required test specimens.
j. Machine spindle speed for cutting shall be 1100 to 4200 rpm.
k. Use feed rate of 1 to 3 feet per minute.
l. Use water liberally as a collant during cutting unless otherwise directed.

NOTE: AFTER CLEANING, THE FINISHED TEST SPECIMENS SHOULD HAVE SMOOTH SHARP CUT EDGES, SQUARE CORNERS, AND SQUARE EDGES WITH NO TAPERS OR FEATHERED EDGES. FEATHERED EDGES CAN BE PREVENTED BY HAVING THE DIAMOND WHEEL EXTEND APPROXIMATELY 1/32 TO 1/16 INCH BELOW THE PANEL DURING CUTTING.

5.5.4.1.5 Drilling holes in tabs.

a. Place tabbed and cut test specimen in drilling fixture. Tighten sides down to ensure proper alignment.
b. Using 3/16" carbide tipped bit, drill through tabbing material.

5.5.4.1.6 Application of Strain Gages. Strain gages shall be applied to test specimens in accordance with the following:

5.5.4.1.7 Preparation of specimen surface.

a. Remove remaining peel ply from both sides of specimen, then, using 220 grit emery cloth, sand area in which strain gage is to be located just enough to smooth the surface.
b. Thoroughly degrease the area with MEK.
c. Using a cotton swab soaked in a neutralizer, wipe sanded area in one direction. Using gauze or cheesecloth, wipe off neutralizer.
d. Using a pencil, mark centering lines for location of gage.

5:5.4.1.8 Application of gage.

a. Remove gage from package. Do not touch surface of gage which is to be bonded.
b. Using a strip of transparent tape, touch top of gage so that it adheres to the tape. The tape will be used to transfer the gage to the specimen.
c. Apply a thin coat of Eastman 910 catalyst to the gage only and allow to dry.
d. Set gage on specimen, aligning with pencil centering lines and rub tape down.
e. Peel back one end of the transparent tape so that the gage is pulled back and is not touching specimen.
f. Apply just enough Eastman 910 to form a bead at the junction of the tape still adhering to the specimen and the specimen.
g. Place thumb on secured end of tape and push forward rolling the gage onto the specimen.
h. Use finger pressure to hold gage against specimen for a minimum of one minute. Allow to dry 2 to 3 minutes.
i. Remove transparent tape slowly at a 180° peel angle to ensure gage will not lift off.
j. Remove excess adhesive with an X-acto knife.

5.5.4.1.9 Connecting lead wires.

a. Lead wire should be approximately 13 inches in length and soldered and trimmed both ends.
b. Bend the end of the wire that is to be connected to the gage into the shape shown in FIG. 16A.

c. Put a small amount of flux onto gage tabs and solder a small dot of solder onto each tab.
d. Holding lead wire down on top of the solder dot, touch iron on wire. This will solder the lead to the tab. Repeat for the other lead.
e. Remove any flux left with a cotton swab or soft brush soaked in MEK.
f. Using ½" tape, fold a loop in the wire and tape it down ¼" from gage.
g. Apply one coat of Gagekote and allow to dry.
h. Trim excess Gagekote from sides of specimen.
i. Check resistance using an ohmmeter.
j. Each specimen shall be visually and dimensionally inspected prior to testing. Any flaws or irregularities in fiber orientation, fiber spacing, etc., are to be recorded as part of the test data. Use a suitable ball type micrometer reading to at least 0.001 inch to measure specimen. Use minimum measurements of each specimen for calculating values.

5.5.5 Strain Gage Calibration. Each strain gage attached to the specimen must be calibrated prior to running the test. The gages are actually fine wire which stretch or compress with the specimen and thus increase or decrease in diameter. This changes the electrical resistance of the wire, and when calibrated, can be related to strain in the gage by changing one of the normally constant resistors in the measurement system a known amount. By interpreting this resistance change as though it were occuring at the strain gage, calculations can be made to determine the amount of strain the resistance change represents. The exact procedure is as follows:

a. A 10,000 ohm resistor will be used for shunt calibration.
b. Determine the elongation range needed for practical strain measurement by noting the expected elongation at failure. Note also the gage factor and resistance of the gage.
c. Convert this expected elongation at failure to strain in inches per inch by dividing by 100.
   $R_{cal}$=selected calibration resistance, ohms=10,000
   Where:
   $R_g$=gage resistance, ohms (given)
   N=number of active arms (variable resistors). This will normally be one (1), the resistance gage.
   GF=gage factors (given)
   L/L=selected strain, inches per inch (% expected elongation divided by 100)
d. From the formula below, determine the strain that this selected resistance represents:

$$L/L = R_g N (GF) R_{cal}$$

e. Set the recorder pen to read this strain directly on chart. Thus, if the calculated strain is 0.00126 inches per inch (0.126%), then pen is set to 1.26 inches on the chart. A one inch deflection on the chart would then represent a 0.001 inch/inch strain and a direct readout of strain is possible.
f. It may be in some cases desirable to set the pen at some multiple of the calculated strain. For a 0.00126 inch per inch calculated strain, the pen may be set to 2.52 inches on the chart. Then the direct readout would be such that a two inch deflection would represent a 0.001 inch/inch strain.
g. Repeat the calibration for each gage on the sample.
h. When no gages are attached to the sample, this calibration of strain does not apply.

5.5.5.1 Longitudinal tensile test. The 0° tensile test procedure shall be as follows:

a. Mount the test specimen (see FIG. 15) into the modified Instron grips as shown in FIG. 16. Manually lower the crosshead until the Instron grips contact the specimen. Allow the specimen to align itself by the self-tightening action of the Instron grips.
b. The crosshead speed shall be 0.5 inch/minute unless otherwise specified.

5.5.5.2 Tensile strength. Calculate the tensile strength of the 0° laminate specimens as follows (see FIG. 17):

$$\text{Tensile strength, psi} = \frac{\text{maximum load, lbs.}}{\text{cross sectional area, in}^2}$$

5.5.5.3 Elongation at failure. The elongation at failure is read directly from the axial strain gage curve at the point of failure and reported as percentage (see FIG. 17). % elongation=reading at failure from axial strain gage curve.

5.5.5.4 Tensile modulus of elasticity. Determine the tensile modulus as follows:

a. Construct a line tangent to the axial strain gage curve at 0.4% strain (see FIG. 17).
b. Determine the load at 0.4% strain on the chart and calculate the slope of the line.

$$\text{Slope of load displacement (See FIG. 17)} = \frac{\text{load at 0.4\% strain, lbs.}}{B' \text{ inches/inch}}$$

c. Use this value to calculate the tensile modulus as follows:

$$\text{Tensile modulus, psi} = \frac{\text{slope of load displacement, lbs.}}{\text{cross sectional area, in}^2}$$

d. Tensile strength and modulus shall be normalized to 100% fiber volume by dividing numbers obtained by fiber fraction in the panel.

5.5.5.5 Short Beam Shear Strength. The short beam shear strength of the laminates shall be determined in accordance with the following:

5.5.5.6 Test specimens. Test specimens shall be prepared in accordance with the following:

a. Cut specimens to finished dimensions from unidirectional laminates with plies parallel to the longitudinal axis.
b. Each specimen shall be visually and dimensionally inspected prior to testing. A suitable ball type micrometer reading to at least 0.001 inch shall be used. Any flaws or irregularities in fiber orientation, fiber spacing, etc., are to be recorded as part of the test data. Use minimum measurements of each specimen for calculating values.
c. Specimen shall be 0.080 nominal thick, 0.250±0.005" wide, 0.60±0.05" long.

5.5.5.7 Short beam shear test. The short beam shear test procedure shall be as follows:

a. Set the crosshead speed at 0.05 inch/minute unless otherwise specified.

b. Adjust the support noses to a span 4 times the average specimen thickness for the lot being tested unless otherwise specified. Span is to be measured with a rule.

c. The loading nose shall have a 0.250 inch diameter and support noses shall have a 0.125 inch diameter unless otherwise specified. Run test at 77°±5° F.

d. Using forceps, install the specimen in the test fixture on the support noses. Align the specimen by pushing specimen back until it rests against the rear stops on the support noses, and center it on the two noses.

e. operate the machine to specimen failure according to the Instron Instructions manual.

f. Calculate the short beam shear strength at failure as follows:

$$A = \frac{3p}{4bt}$$

Where:
A=short beam shear stress, psi
p=total load at failure, lbs.
b=specimen width, in.
t=specimen thickness, in.

5.6 Compressive Strength—Determine according to ASTMD 695. The resin used was Hercules 3501-6 resin. An alternate resin is shown in 5.3.1 (II) and (III).

APPENDIX III

Determination of Dry Heat Tension

1. Scope
   1.1. This test method covers the dry heat tension of acrylic filament yarn as a carbon precursor from 1 Kf to 12 Kf, which is related to extensibility under oxidation process.
2. Requirements
   2.1. Equipments (FIG. 21)
      2.1.1. A set of yarn running device including a heat plate and an electric furnace.
      2.1.2. Temperature control device.
      2.1.3. 3.0 Kg tension meter.
      2.1.4. A recorder.
      2.1.5. A cheese holder.
3. Test Procedure
   3.1 Preparation for measurement.
      3.1.1. Adjust measuring conditions. Standard conditions are as follows:

| | |
|---|---|
| running speed of sample yarn | 0.7 m/min |
| stretch ratio | 1.20 × |
| temperature of heat plate | 280° C. |
| chart speed of recorder | 2 cm/min |
| full scale of recorder chart | 500 g for 1000 filaments<br>1500 g for 3000 filaments<br>3000 g for 12000 filaments |

Figure 21:
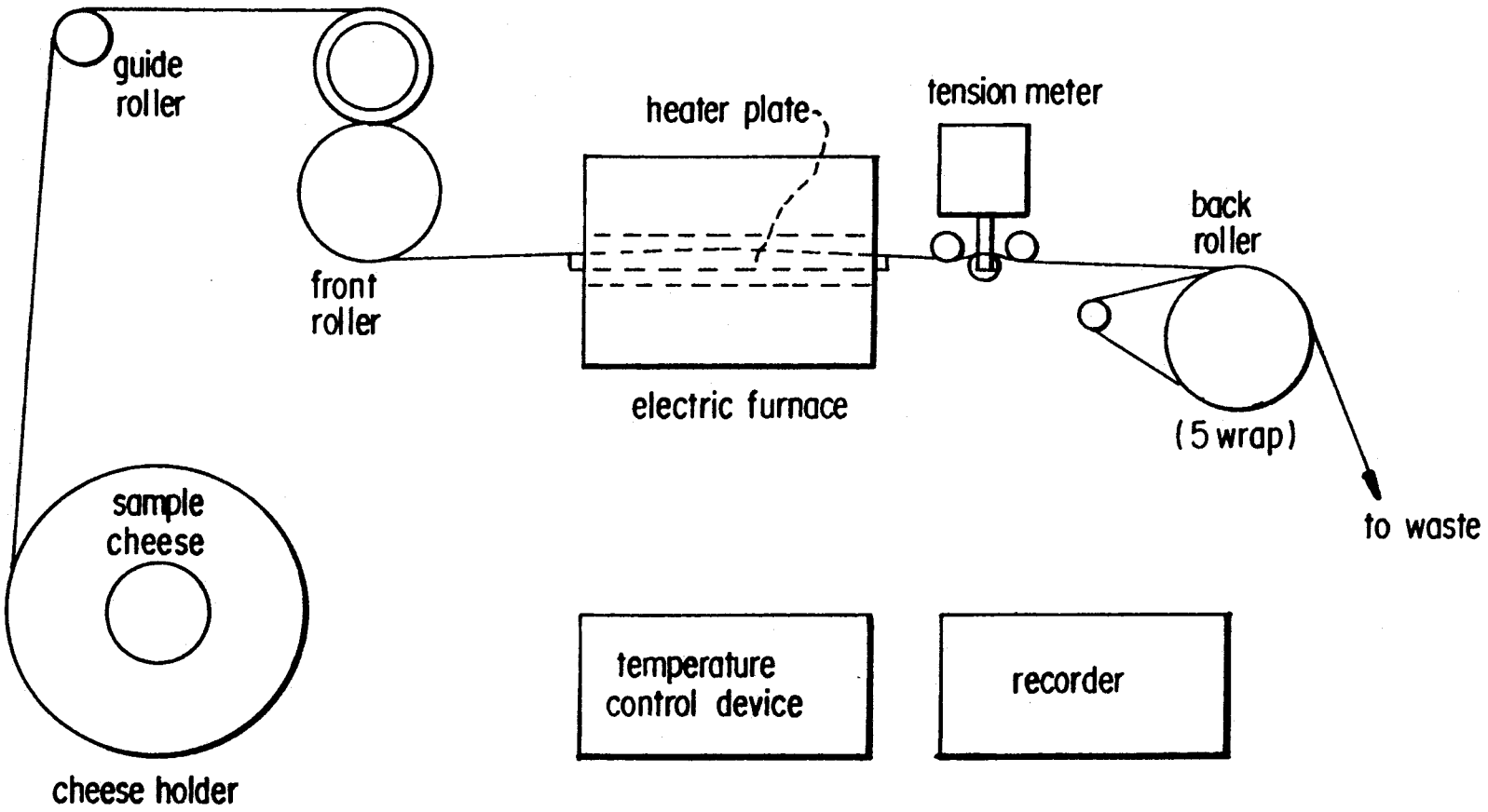
FIGS. 21, 22 and 23 depict apparatus and procedure in connection with characterizing the polyacrylonitrile precursor (as to dry heat tension (DHT) and dry heat elongation (DHE) by the methods of Appendices III and IV.

3.2. Measurement
      3.2.1. Check the reproduceability of tension level by measuring a blank sample.
      3.2.2. Set the sample yarn on the yarn running device as shown in FIG. 21.
      3.2.3. Start yarn running, then record the tension time relation for about 10 minutes.
   3.3. Calculation
      3.3.1. Read mean value of tension for each 1 cm on the chart.
      3.3.2.

$$\text{Dry heat tension } (g/d) = \frac{Z}{n\,D}$$

where
Z=sum of the individual tension datum (g)
n=number of tension data
D=nominal tow denier

APPENDIX IV

Determination of Dry Heat Elongation

Figure 22:
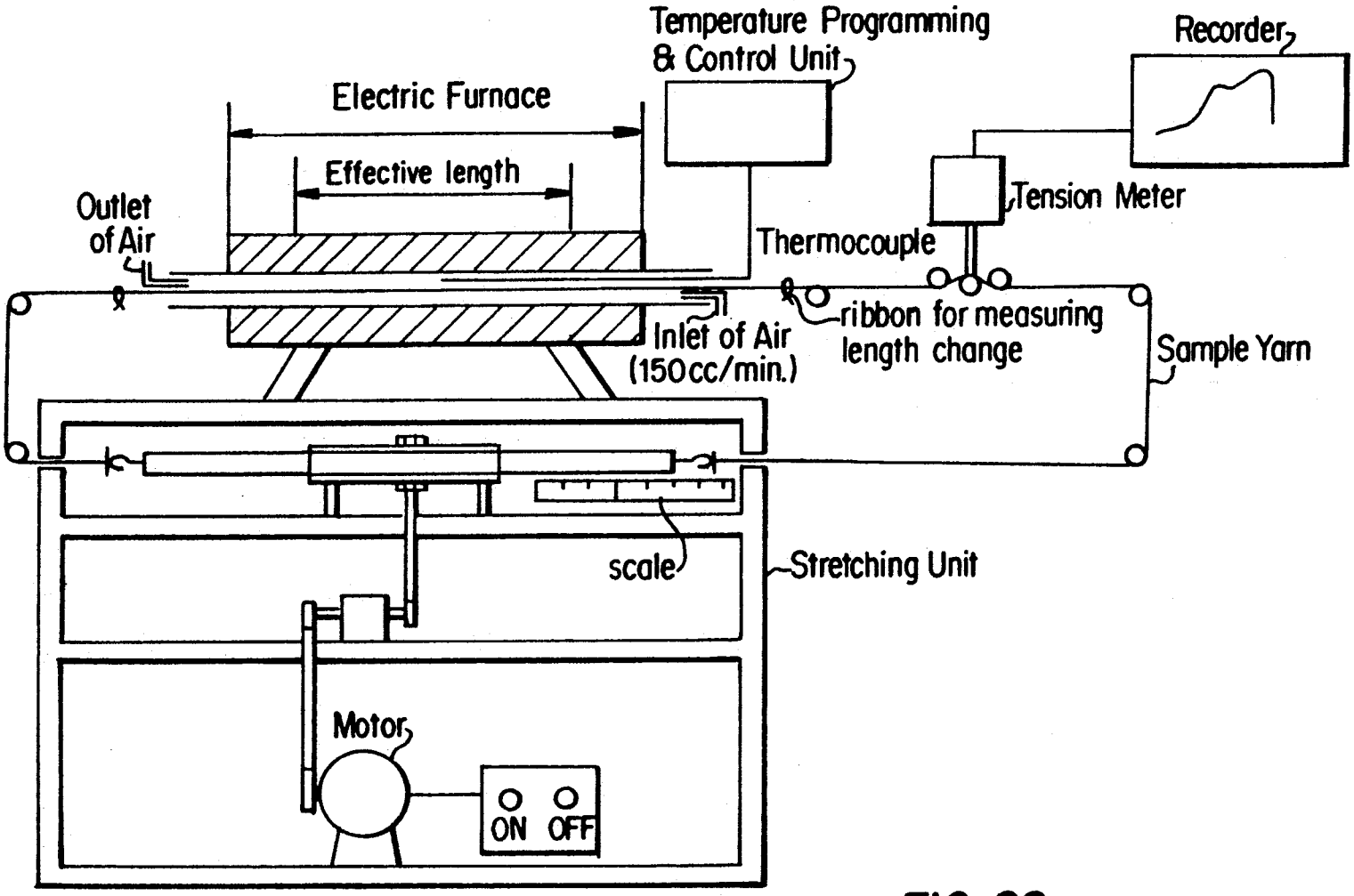
Figure 23:
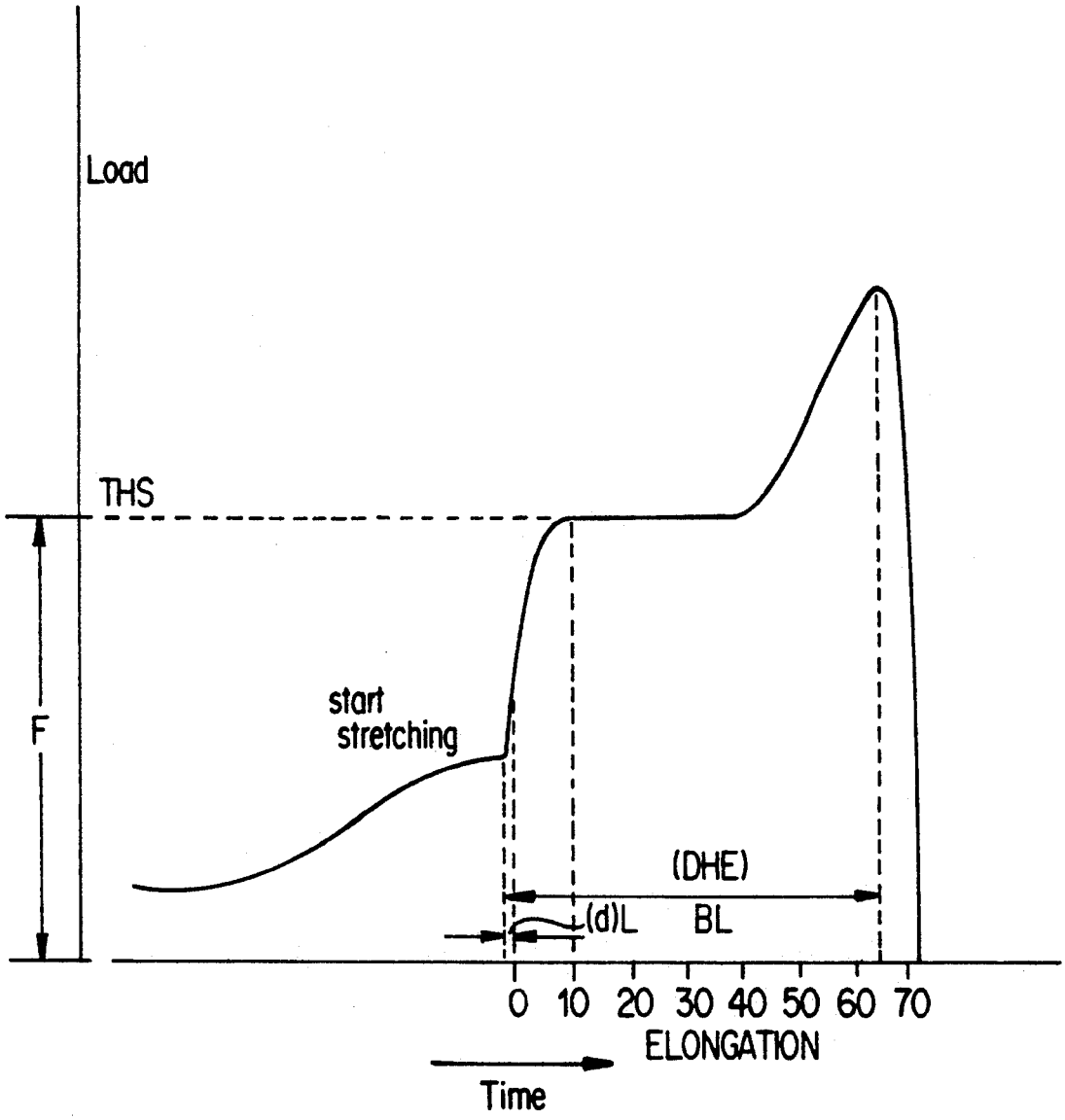

1. Scope
   1.1. This test method covers the dry heat elongation of acyrlic filament yarn as a carbon precursor from one to twelve thousand filaments per bundle.
2. Requirements
   2.1 Equipment
      2.1.1. Apparatus for measuring of Dry Heat Elongation, including
         electric furance, 600 mm in length, having an effective length of 400 mm.
         stretching unit,
         tension meter,
         temperature programing and control unit, and recorder.
3. Test Procedures
   3.1. Preparation for measuring
      3.1.1. Adjust the measuring conditions as follows,
         Temperature program: temperature increased from room temperature to 160° C. where stretching starts and then increased to 225° C.
         Stretching speed: 16 mm/min.
         Chart speed: 10 mm/min.
         Initial weight: 0.02 g/d
         Full scale:
            1 Kg for 1 Kfilaments
            2 Kg for 3 Kfilaments
            5 Kg for 6 Kfilaiments
            10 Kg for 12 Kfilaments
      3.1.2. Set the sample yarn to the apparatus as shown in FIG. 22.
   3.2. Measurement
      3.2.1. Start heating to 160° C. at the constant rate of heating.
      3.2.2. Measure the length between ribbons attached to the sample yarn.
      3.2.3. Start stretching at 160° C. and continue stretching until yarn beaking. Write a check mark on the cart at 10% elongation.
   3.3. Calculation
      3.3.1. Thermal Stress at 10% Elongation (THS)

$$THS = \frac{F}{D}\ (g/d)$$

where
F=load at 10% elongation as shown in FIG. 23.
D=nominal denier 3.3.2. Dry Heat Elongation (DHE)

$$DHE = \left(\frac{BL \times CS}{EL} - \frac{(d)L}{EL}\right) \times 100 = 0.4 \times BL - 2.5^{*}\ (\%)$$

where
BL=breaking elongation on chart (mm)

SS=stretching speed (mm/min)
CS=chart speed (mm/min)
EL=effective length of electric furnace (mm)
(d)L=length change between ribbons of samples yarn by heating from room temperature to 160° C. (mm)

*Note: (d)L/EL is a correction value for the shrinkage by heating from room temperature to 160° C. Assume value of 2.5%.

What I claim and desire to protect by Letter Patent is:

1. A polyacrylonitrile-based carbon fiber in the form of a tow comprising a multitude of continuous filaments, said carbon fiber having a modulus in a Tow Test between about 59 and 75 million psi and a tensile strength in said Tow Test between about 500 and 800 thousand psi.

2. The carbon fiber in accordance with claim 1 which has a filament with a diameter between about 3 and 5 microns.

3. The carbon fiber in accordance with claim 1 which has a compressive strength (as determined by ASTM D-695) of between about 120 and 200 thousand psi at 62% fiber volume.

4. The carbon fiber in accordance with claim 1, wherein said modulus is between about 60 and 70 million psi.

5. The carbon fiber of claim 3 which has been surface treated and has a modulus between about 59 and 67 million in a Tow Test, a tensile strength between about 500 and 650 thousand psi in the Tow Test.

6. The carbon fiber in accordance with claim 1 which has a density between about 1.8 and 1.88 grams per cubic centimeter.

7. The carbon fiber in accordance with claim 1 which has a tensile elongation between 0.80 and 1.15%.

8. A method of making high modulus carbon fiber, said carbon fiber having a modulus of at least 59 million psi in a Tow Test and a tensile strength at least about 500 thousand psi in a Tow Test, said method comprising:

stretching a previously stretched and oxidized polyacrylonitrile precursor as it passes through low and first high temperature furnaces followed by stretching the resulting carbonized precursor once again as it passes through a second high temperature furnace having a temperature greater than said first high temperature furnace and more than 2000° C., the heat up rate during passage through said low temperature furnace being between about 500° and 1000° C. per minute.

9. The process according to claim 8, wherein said previously stretched and oxidized polyacrylonitrile precursor has been stretched to between 1.05 and 1.2 times its length upon entry to oxidation ovens as it passes through said oxidation ovens maintained between 200° and 300° C.

10. The process in accordance with claim 9, wherein said previously stretched and oxidized precursor has been stretched prior to significant oxidation.

11. The process in accordance with claim 8, wherein said previously stretched and oxidized precursor has been previously stretched up to 3.5 times its original length prior to oxidation during its passage through an oven maintained between 150° and 170° C. wherein said original length is defined by the length of the precursor entering said oven maintained between 150° C. and 170° C.

12. The process in accordance with claim 8, wherein said low temperature and said first and second high temperature furnaces have a temperature that increases from a location nearer the entry to a location nearer the exit.

13. The carbon fiber of claim 1 has a short beam shear strength in a Laminate Test between about 6 and 15 thousand psi.

14. The method of claim 8 wherein the resulting high modulus carbon fiber is passed through means for electrolytic surface treatment thereof providing said carbon fiber with a short beam shear strength of at least 6 thousand psi in a Laminate Test.

* * * * *

UNITED STATES PATENT AND TRADEMARK OFFICE

CERTIFICATE OF CORRECTION

PATENT NO. : 5,268,158

DATED : December 7, 1993

INVENTOR(S) : James T. Paul, Jr. and Warren C. Schimpf

It is certified that error appears in the above-identified patent and that said Letters Patent is hereby corrected as shown below:

On title page, item [19] change
"Paul, Jr." to --Paul, Jr. et al.--; and

On title page, item [75] after
"James T. Paul, Jr., Wilmington, Del." insert
--Warren C. Schimpf, Wilmington, Del.--.

Signed and Sealed this

Third Day of May, 1994

Bruce Lehman

*Attest:*

BRUCE LEHMAN

*Attesting Officer*

*Commissioner of Patents and Trademarks*